US012551014B1

(12) United States Patent
Suprina

(10) Patent No.: US 12,551,014 B1
(45) Date of Patent: Feb. 17, 2026

(54) ADJUSTABLE FLOOR TRACK AND SEATING SYSTEM FOR TIERED SEATING

(71) Applicant: Chandler Scott Suprina, Northport, NY (US)

(72) Inventor: Chandler Scott Suprina, Northport, NY (US)

( * ) Notice: Subject to any disclaimer, the term of this patent is extended or adjusted under 35 U.S.C. 154(b) by 114 days.

(21) Appl. No.: 18/648,877

(22) Filed: Apr. 29, 2024

Related U.S. Application Data

(60) Provisional application No. 63/627,230, filed on Jan. 31, 2024, provisional application No. 63/463,194, filed on May 1, 2023.

(51) Int. Cl.

| | |
|---|---|
| ***A47C 1/124*** | (2006.01) |
| ***A47C 1/121*** | (2006.01) |
| ***A47C 16/02*** | (2006.01) |
| ***E04H 3/12*** | (2006.01) |
| *A47C 7/62* | (2006.01) |

(52) U.S. Cl.
CPC ..... *A47C 1/121* (2013.01); *A47C 16/025* (2013.01); *E04H 3/126* (2013.01); *A47C 1/124* (2013.01); *A47C 7/624* (2018.08)

(58) Field of Classification Search
CPC ..... A47C 1/121; A47C 16/025; A47C 1/124; A47C 7/624; E04H 3/126
See application file for complete search history.

(56) References Cited

U.S. PATENT DOCUMENTS

| | | | | |
|---|---|---|---|---|
| 3,142,871 A * | 8/1964 | Harms | E04H 3/126 52/10 |
| 5,556,167 A * | 9/1996 | Johnson Siemion | A47C 16/02 297/423.15 |
| 7,172,245 B2 * | 2/2007 | Bouchard | E04H 3/126 297/331 |
| 2025/0122738 A1 * | 4/2025 | Phillips | A47C 1/12 |

FOREIGN PATENT DOCUMENTS

| | | | |
|---|---|---|---|
| KR | 101061440 B1 * | 9/2011 | E04H 3/123 |

* cited by examiner

*Primary Examiner* — Brian M O'Hara

(57) ABSTRACT

An adjustable floor track and seating system for including height-adjustable seating and corresponding height-adjustable footrests for tiered seating, particularly on a flat surface.

21 Claims, 25 Drawing Sheets

902

902

902

| GR6319 | GRID \| SLED QUADRUPLE \| 838MM WITH GR6336 AND GR6337 AND GR6358 \| DRE \| CT \| OUTDOOR \| ASSY | | | |
|---|---|---|---|---|
| ITEM | PART NO. | DESCRIPTION | FINISH | QTY |
| 1 | GR6336 | GRID \| STEEL LEG WITH LOCK AND FOOT REST - H84 \| CT \| H270-BACKWARD 1 ° \| SUB-ASSY | SEE SEPARATE DRAWING | 1 |
| 2 | GR6337 | GRID \| STEEL LEG WITH LOCK AND FOOT REST - H136 \| CT \| H346-BACKWARD 1 ° \| SUB-ASSY | SEE SEPARATE DRAWING | 1 |
| 3 | GR6358 | GRID \| DOUBLE STEEL LEG WITH LOCK \| CT \| H422 - BACKWARD 1 ° +H499 \| SUB-ASSY | SEE SEPARATE DRAWING | 1 |
| 4 | GR66012 | GRID \| AL EXTRUSION SLED \| CUT LENGTH:2974MM(DRE) | AL6063 T6 + ANODIZE SILVER | 1 |
| 5 | GR66015 | GRID \| MATRIX GUDE \| MOULDING | PP C01 BLACK | 2 |
| 6 | FX60103 | FIXING \| SCREW \| 5 X 15 \| C/SUNK \| PHILIP HEAD | 304 STAINLESS NATURAL | 4 |
| 7 | FX60344 | FIXING \| SCREW \| 8 X 20 \| C/SUNK \| SOCKET | 8.5 GRADE CARBON STEEL + SILVER DACROMET | 12 |
| 8 | FX60327 | FIXING \| RIVET \| M6 \| FLAT HEAD \| STEEL | STEEL + ZINC PLATING | 12 |

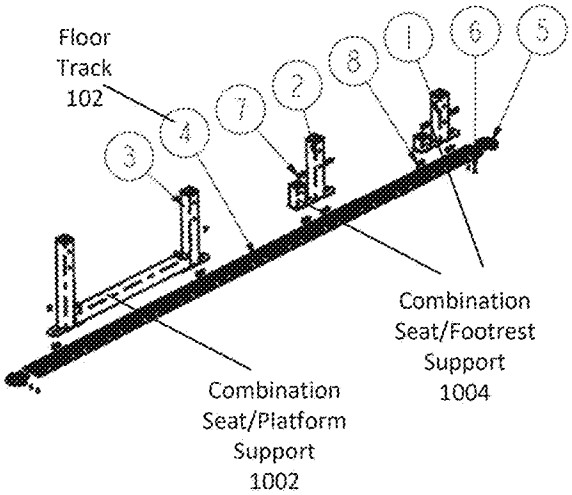

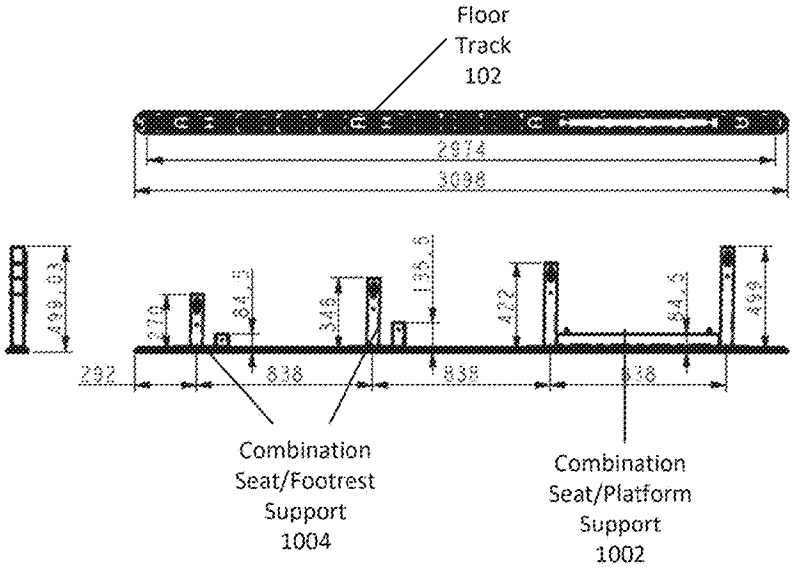

FIG. 16

| GR6336 APPENDIX | | GRID \| STEEL LEG WITH LOCK AND FOOT REST - H84 \| CT \| H270-BACKWARD 1 ° \| SUB-ASSY | | |
|---|---|---|---|---|
| ITEM | PART NO. | DESCRIPTION | FINISH | QTY |
| 1 | GR6486 | GRID \| STEEL LEG WITH LOCK AND FOOT REST - H84 \| CT \| H270-BACKWARD 1 ° \| WELDMENT | SEE SEPARATE DRAWING | 1 |
| 2 | GR66020 | GRID \| SCABBARD - TIGHT \| MOULDING | PP C01 BLACK | 1 |
| 3 | GR66026 | GRID \| LIMPET LOCK HOUSING \| MOULDING | PP C01 BLACK | 1 |
| 4 | GR66027 | GRID \| LIMPET LOCK PIN \| MOULDING | PP C01 BLACK | 1 |
| 5 | FX90257 | FIXING \| SCREW \| 5 X 8 \| TRILOB \| MACHINE | 8.8 GRADE CARBON STEEL + BLACK DACROMET | 2 |
| 6 | FX90247 | FIXING \| SCREW \| 6.3 X 16 \| TRILOB \| TORX T-25 \| PANHEAD | SUS-302 STAINLESS + BLACK DACROMET | 2 |

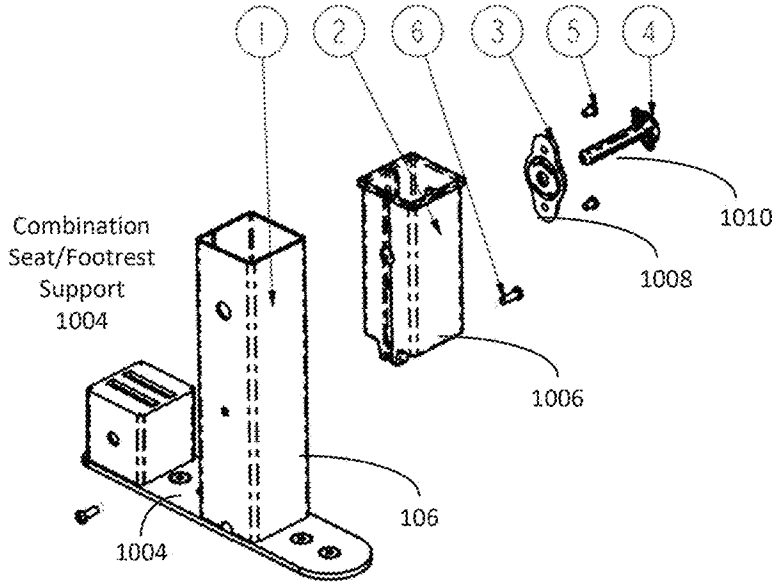

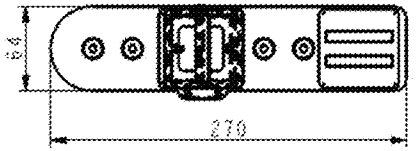

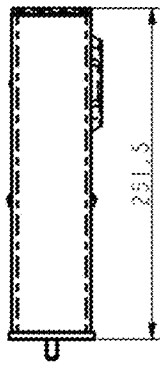

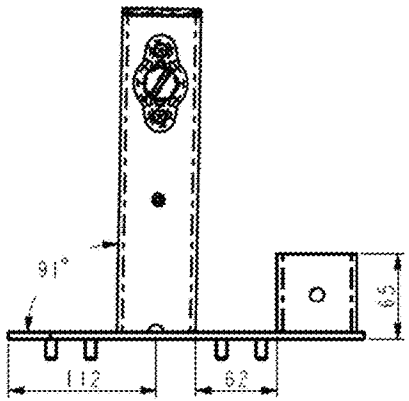

FIG. 19

| GR6337 APPENDIX | | GRID \| STEEL LEG WITH LOCK AND FOOT REST - H136 \| CT \| H346-BACKWARD 1 ° \| SUB-ASSY | | |
|---|---|---|---|---|
| ITEM | PART NO. | DESCRIPTION | FINISH | QTY |
| 1 | GR6487 | GRID \| STEEL LEG WITH LOCK AND FOOT REST – H136 \| CT \| H346-BACKWARD 1 ° \| WELDMENT | SEE SEPARATE DRAWING | 1 |
| 2 | GR66020 | GRID \| SCABBARD - TIGHT \| MOULDING | PP C01 BLACK | 1 |
| 3 | GR66026 | GRID \| LIMPET LOCK HOUSING \| MOULDING | PP C01 BLACK | 1 |
| 4 | GR66027 | GRID \| LIMPET LOCK PIN \| MOULDING | PP C01 BLACK | 1 |
| 5 | FX90257 | FIXING \| SCREW \| 5 X 8 \| TRILOB \| MACHINE | 8.8 GRADE CARBON STEEL + BLACK DACROMET | 2 |
| 6 | FX90247 | FIXING \| SCREW \| 5.3 X 16 \| TRILOB \| TORX T-25 \| PANHEAD | SUS-302 STAINLESS + BLACK DACROMET | 2 |

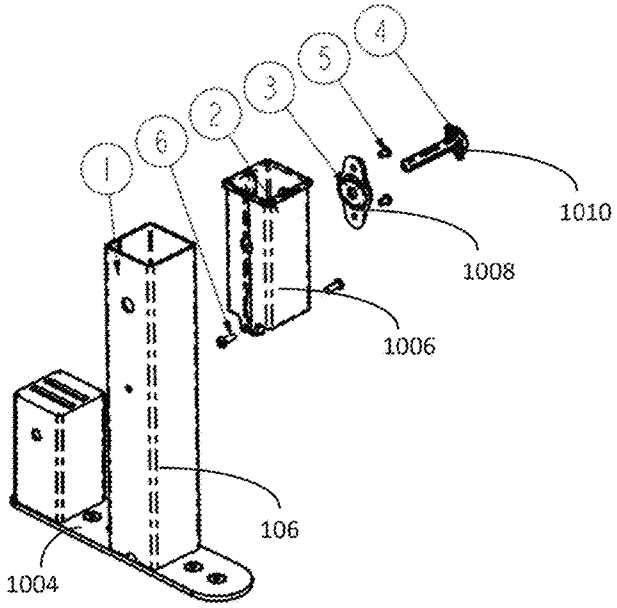

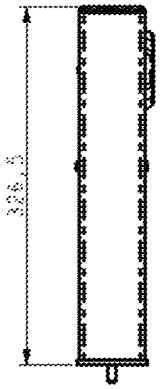

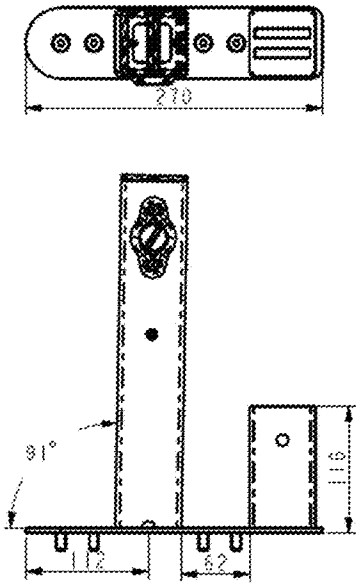

FIG. 20

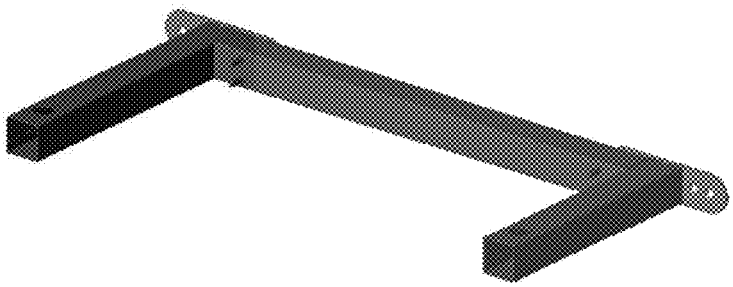
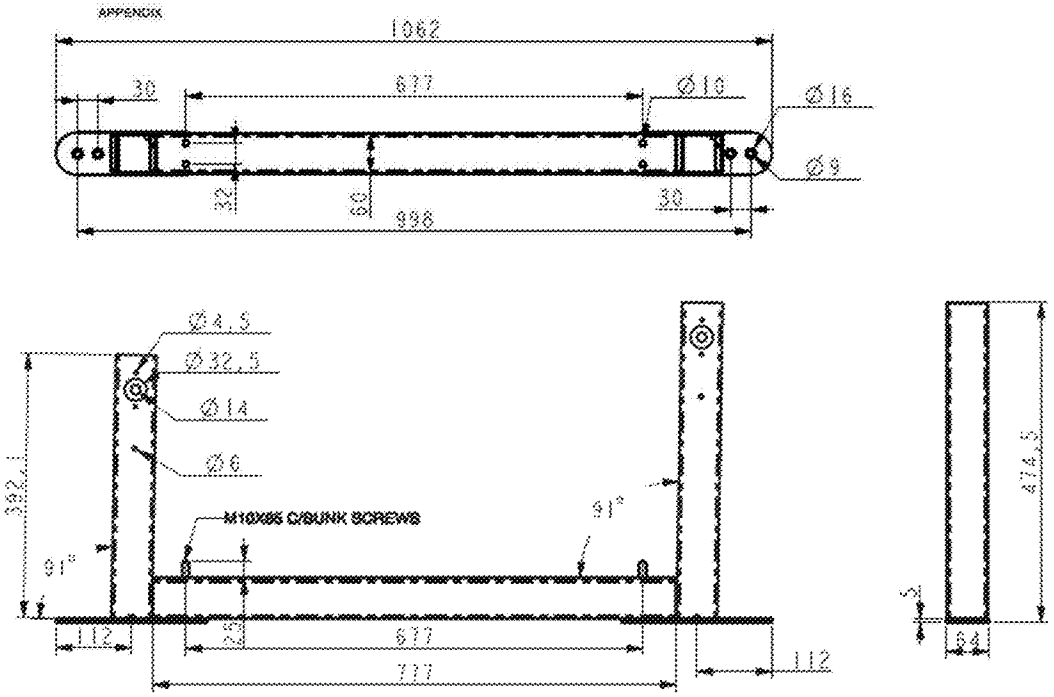
FIG. 21

| GR6358 APPENDIX | | GRID \| DOUBLE STEEL LEG WITH LOCK \| CT \| H422 - BACKWARD 1 ´+H499 - BACKWARD 1 ´ \| SUB-ASSY | | |
|---|---|---|---|---|
| ITEM | PART NO. | DESCRIPTION | FINISH | QTY |
| 1 | GR6458 | GRID \| DOUBLE STEEL LEG WITH LOCK \| CT \| H422-BACKWARD 1 ´ +H499 \| WELDMENT | SEE SEPARATE DRAWING | 1 |
| 2 | GR66020 | GRID \| SCABBARD - TIGHT \| MOULDING | PP C01 BLACK | 2 |
| 3 | GR66026 | GRID \| LIMPET LOCK HOUSING \| MOULDING | PP C01 BLACK | 2 |
| 4 | GR66027 | GRID \| LIMPET LOCK PIN \| MOULDING | PP C01 BLACK | 2 |
| 5 | FX90257 | FIXING \| SCREW \| 5 X 8 \| TRILOB \| MACHINE | 8.8 GRADE CARBON STEEL + BLACK DACROMET | 4 |
| 6 | FX90247 | FIXING \| SCREW \| 5.3 X 18 \| TRILOB \| TORX T-25 \| PANHEAD | SUS-302 STAINLESS + BLACK DACROMET | 4 |

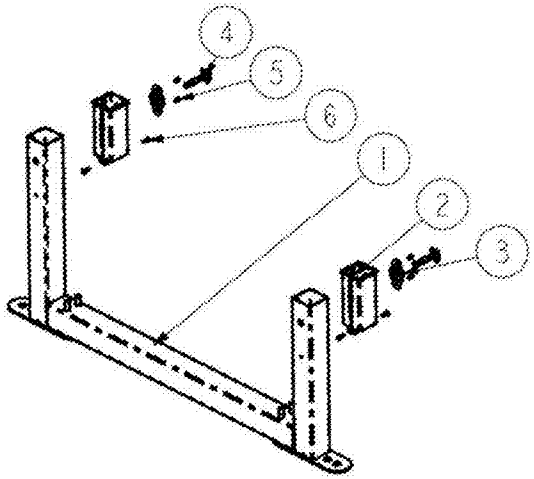

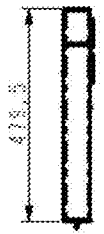

Combination Seat/Platform Support 1002

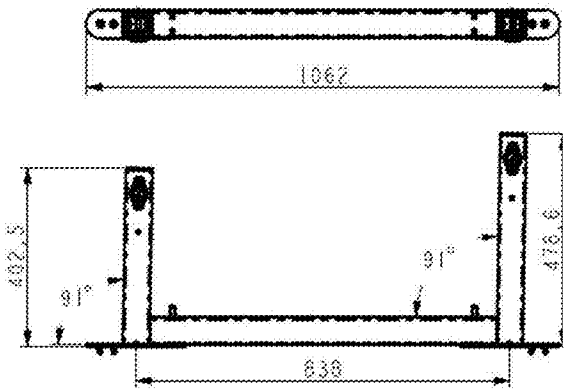

FIG. 22

| GR7346 APPENDIX | | GRID \| STILLAGE \| L1150-CSR1561 \| DRE \| ASSY | | |
|---|---|---|---|---|
| ITEM | PART NO. | DESCRIPTION | SPECIFICATION | QTY |
| 1 | GR7378 | GRID \| STILLAGE \| L1150-CSR1561 \| DRE \| WELDMENT | AL6063-T6, MILL FINISHING | 1 |
| 2 | GR73031-LH | GRID \| STILLAGE \| SCABBARD \| LH \| PRESSING | 240MPA STEEL + CLEAR ZINC PLATING | 7 |
| 3 | GR73031-RH | GRID \| STILLAGE \| SCABBARD \| RH \| PRESSING | 240MPA STEEL + CLEAR ZINC PLATING | 7 |
| 4 | GR73031 | GRID \| STILLAGE \| SCABBARD \| PRESSING | 240MPA STEEL + CLEAR ZINC PLATING | 14 |
| 5 | GR73032 | GRID \| STILLAGE POST \| 51 X 51 X 3.5 X1050 \| EXTRUSION | AL6063-T6, MILL FINISHING | 4 |
| 6 | GR7398 | GRID \| STILLAGE \| CASTOR KIT \| WITH BRAKE \| ASSY | 240MPA STEEL + CLEAR ZINC PLATING | 2 |
| 7 | GR7399 | GRID \| STILLAGE \| CASTOR KIT \| WITHOUT BRAKE \| ASSY | 240MPA STEEL + CLEAR ZINC PLATING | 2 |
| 8 | FX90336 | FIXING \| POP RIVET \| 5.0 X 12 \| ALU | ALUMINUM | 112 |

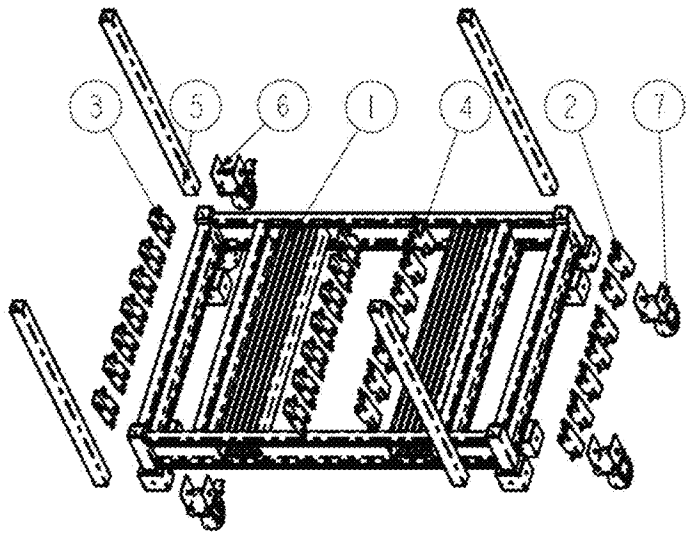

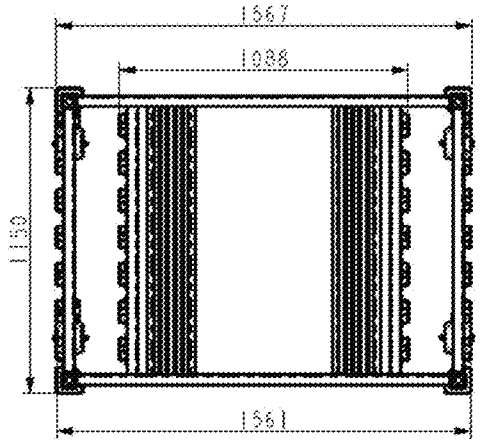

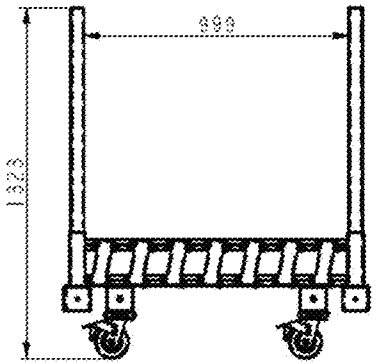

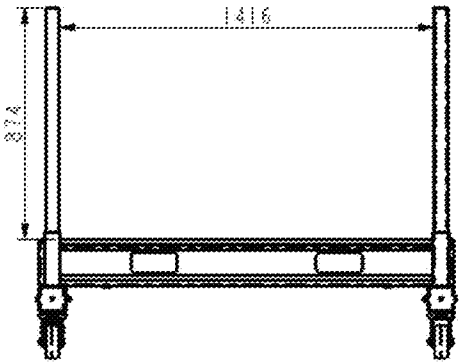

FIG. 24

ADJUSTABLE FLOOR TRACK AND SEATING SYSTEM FOR TIERED SEATING

CROSS-REFERENCE TO RELATED APPLICATION(S)

This patent application claims the benefit of U.S. Provisional Patent Application No. 63/627,230 entitled ADJUSTABLE FLOOR TRACK AND SEATING SYSTEM FOR TIERED SEATING filed Jan. 31, 2024 and U.S. Provisional Patent Application No. 63/463,194 entitled ADJUSTABLE FLOOR TRACK AND SEATING SYSTEM FOR TIERED SEATING filed May 1, 2023, each of which is hereby incorporated herein by reference in its entirety.

FIELD OF THE INVENTION

The invention generally relates to an adjustable floor track and seating system for tiered seating.

BACKGROUND OF THE INVENTION

Many venues utilize tiered seating arrangements, sometimes referred to as "stadium seating" arrangements, to enable all participants a chance to better see the event (e.g., a sporting event, a concert, a lecture, a movie, etc.). One way to accomplish tiered seating is to place folding chairs on different height risers, e.g., ranging in height from around 0.5" to around 12", to produce seating tiers of different heights.

SUMMARY OF VARIOUS EMBODIMENTS

In accordance with one embodiment of the invention, a floor track for a seating system comprises a floor track; a first floor track seat support attached to the floor track and configured to attach to a seat support of a first seating module for a first row of seating; and a first floor track footrest support attached to the floor track and configured to attach to a footrest support of a first footrest for a second row of seating behind the first row of seating, wherein the first seating module is height-adjustable via the first floor track seat support and the seat support of the first seating module, and wherein the first footrest is height-adjustable via the first floor track footrest support and the footrest support of the first footrest.

In various alternative embodiments, the floor track may include a height adjusting/locking mechanism for the first floor track seat support and the seat support of the first seating module and/or a height adjusting/locking mechanism for the first floor track footrest support and the footrest support of the first footrest. The first floor track seat support and the first floor track footrest support may be part of a combination seat/footrest support that includes a common floor track seat support base to which the first floor track seat support and the first floor track footrest support are attached.

Embodiments of the floor track may support two or more rows of seating, such as by further comprising a second floor track seat support attached to the floor track and configured to attach to a second seat support of a second seating module for the second row of seating; and a second floor track footrest support attached to the floor track and configured to attach to a second footrest support of a second footrest for a third row of seating behind the second row of seating, wherein the second row of seating is height-adjustable via the second floor track seat support and the second seat support, and wherein the second footrest is height-adjustable via the second floor track footrest support and the second footrest support.

In various embodiments, the first floor track seat support may be configured to support two adjacent seating sections of the first row. The first footrest support may be positioned to allow unimpeded passage through the second row of seating.

In accordance with another embodiment of the invention, a seating system comprises two or more floor tracks including at least a left side floor track and a right side floor track. The left side floor track comprises a first left side floor track seat support attached to the left side floor track and configured to attach to a left side seat support of a first seating module for a first row of seating; and a first left side floor track footrest support attached to the left side floor track and configured to attach to a left side footrest support of a first footrest for a second row of seating behind the first row of seating, wherein the first seating module is height-adjustable via the first left side floor track seat support and the left side seat support of the first seating module, and wherein the first footrest is height-adjustable via the first left side floor track footrest support and the left side footrest support of the first footrest. The right side floor track comprises a first right side floor track seat support attached to the right side floor track and configured to attach to a right side seat support of the first seating module for the first row of seating; and a first right side floor track footrest support attached to the right side floor track and configured to attach to a right side footrest support of the first footrest for the second row of seating behind the first row of seating, wherein the first seating module is height-adjustable via the first right side floor track seat support and the right side seat support of the first seating module, and wherein the first footrest is height-adjustable via the first right side floor track footrest support and the right side footrest support of the first footrest.

In various alternative embodiments, the system may further include a height adjusting/locking mechanism for the first left side floor track seat support and the left side seat support of the first seating module; and a height adjusting/locking mechanism for the first right side floor track seat support and the right side seat support of the first seating module. Additionally or alternatively, the system may include a height adjusting/locking mechanism for the first left side floor track footrest support and the left side footrest support of the first footrest; and a height adjusting/locking mechanism for the first right side floor track footrest support and the right side footrest support of the first footrest. The system may include combination seat/footrest supports.

Embodiments of the system may support two or more rows of seating. For example, the left side floor track may further comprise a second left side floor track seat support attached to the left side floor track and configured to attach to a left side seat support of a second seating module for the second row of seating; and a second left side floor track footrest support attached to the left side floor track and configured to attach to a left side footrest support of a second footrest for a third row of seating behind the second row of seating, wherein the second seating module is height-adjustable via the second left side floor track seat support and the left side seat support of the second seating module, and wherein the second footrest is height-adjustable via the second left side floor track footrest support and the left side footrest support of the second footrest. The right side floor track may further comprise a second right side floor track seat support attached to the right side floor track and configured to receive a right side seat support of the second seating module for the second row of seating; and a second right side floor track footrest support attached to the right side floor track and configured to receive a right side footrest support of the second footrest for the third row of seating behind the second row of seating, wherein the second seating module is height-adjustable via the second right side floor track seat support and the right side seat support of the second seating module, and wherein the second footrest is height-adjustable via the second right side floor track footrest support and the right side footrest support of the second footrest.

In various embodiments, at least one of the first left side floor track seat support or the first right side floor track seat support may be configured to attach to two adjacent seating modules of the first row. The first left side footrest support and the first right side footrest support may be positioned to allow unimpeded passage through the second row of seating.

Embodiments also may include the first seating module, wherein the first seating module comprises the left side seat support attached to the first left side floor track seat support and the right side seat support attached to the first right side floor track seat support, and wherein the first seating module includes at least one seat. The first seating module may include a plurality of seats. Each seat may be a flip-up seat, which may be necessary or desirable for safety or regulations. The first seating module may include a section of round or square tubing to which the at least one seat is attached and that extends between the left side floor track and the right side floor track and includes a vertical left side seat support end portion configured to attach to the first left side floor track seat support and a vertical right side seat support end portion configured to attach to the first right side floor track seat support. The left side seat support may attach to the first left side floor track seat support via a height adjusting/locking mechanism formed by the first left side floor track seat support including a first hole and the left side seat support including a plurality of second holes positioned at different vertical heights such that a bolt or other fastener can pass through the first hole and a selected second hole to position the left side of the first seating module at a selected height from a plurality of available heights. The right side seat support may attach to the first right side floor track seat support via a height adjusting/locking mechanism formed by the first right side floor track seat support including a first hole and the right side seat support including a plurality of second holes positioned at different vertical heights such that a bolt or other fastener can pass through the first hole and a selected second hole to position the right side of the first seating module at a selected height from a plurality of available heights.

In accordance with yet another embodiment of the invention, a combination seat/footrest support for a floor track seating system comprises a floor track seat support base configured to attach to a floor track; a floor track seat support attached to the floor track seat support base and configured to attach to a seat support of a seating module for a first row of seating via a height adjustment/locking mechanism that allows height adjustment of the seating module; and a floor track footrest support attached to the floor track seat support base and configured to attach to a footrest support of a footrest for a second row of seating behind the first row of seating via a height adjustment/locking mechanism that allows height adjustment of the footrest.

Without limitation, additional embodiments can include such things as individual floor track seat supports and floor track footrest supports (i.e., not sharing a common base), combination seat/platform supports that attach to a floor track for supporting two rows of seating and a platform, platforms for use with floor tracks including for support by combination seat/platform supports, seating modules with flip-up/flip-down cup holders and/or trays, seating modules with seat-back cup holders and/or trays.

Additional embodiments may be disclosed and claimed.

BRIEF DESCRIPTION OF THE DRAWINGS

Those skilled in the art should more fully appreciate advantages of various embodiments of the invention from the following "Description of Illustrative Embodiments," discussed with reference to the drawings summarized immediately below.

FIG. 16 is a schematic diagram showing components including a combination seat/platform support and a combination seat/footrest support in accordance with certain embodiments.

FIGS. 19-20 are schematic diagrams showing two combination seat/footrest supports and related lock components in accordance with certain embodiments.

FIG. 21 is a schematic diagram showing front, top, and side views of a combination seat/platform support in accordance with certain embodiments.

FIG. 22 is a schematic diagram showing a combination seat/platform support with related lock components as in FIGS. 19-20 in accordance with certain embodiments.

FIGS. 24-25 are schematic diagrams for a custom wheeled stillage for storing and moving system components in accordance with certain embodiments.

Figure 1:
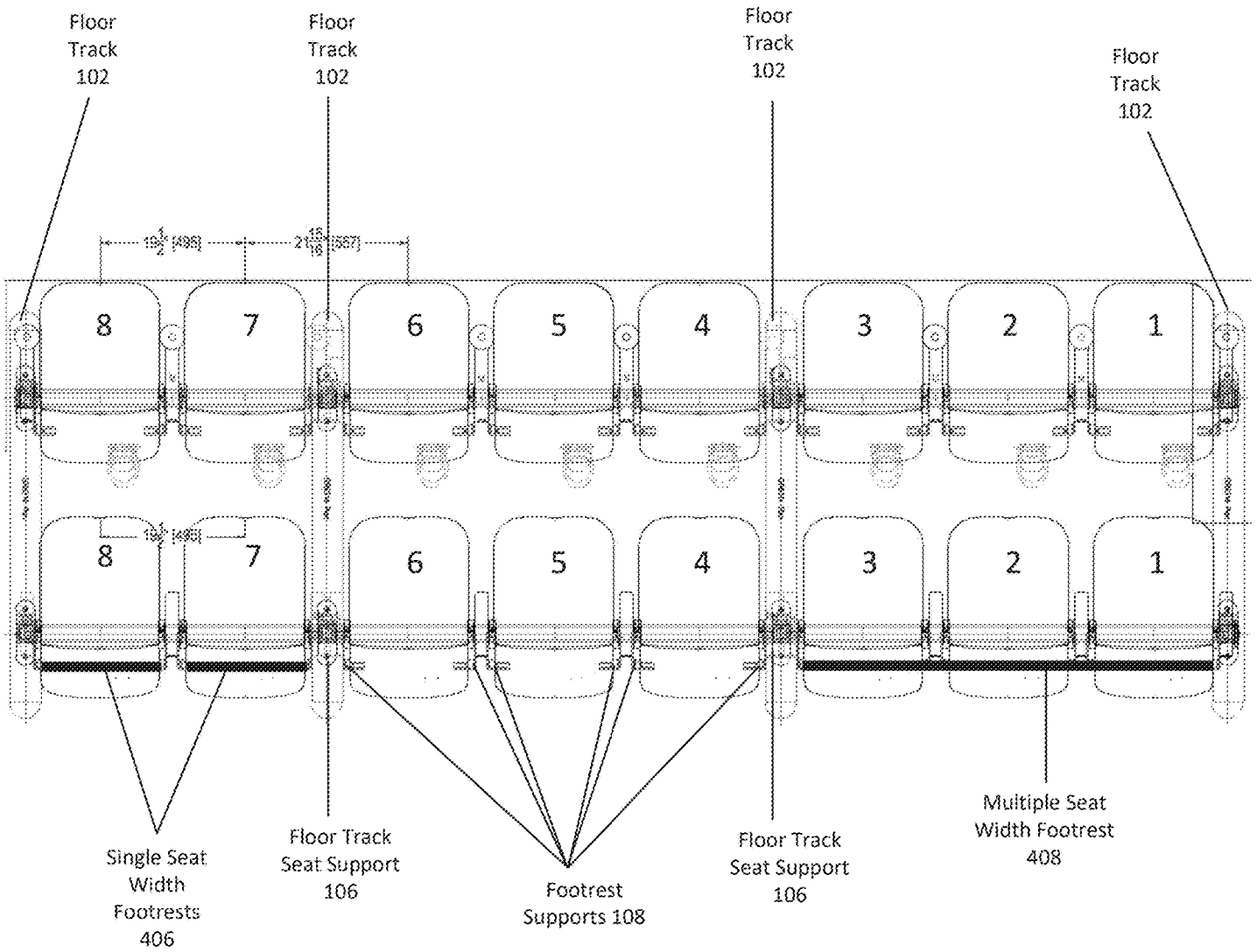
FIG. 1 is a schematic top view diagram of a two-row seating system formed using four floor tracks, in accordance with certain exemplary embodiments.

It should be noted that the foregoing figures and the elements depicted therein are not necessarily drawn to consistent scale or to any scale. Unless the context otherwise suggests, like elements are indicated by like numerals. The drawings are primarily for illustrative purposes and are not intended to limit the scope of the inventive subject matter described herein.

DESCRIPTION OF ILLUSTRATIVE EMBODIMENTS

Definitions. As used in this description and the accompanying claims, the following terms shall have the meanings indicated, unless the context otherwise requires.

A "set" includes one or more members, even if the set description is presented in the plural (e.g., a set of Xs can include one or more X).

"Attach" (e.g., as in "attached to" or attaches to") is open-ended and can mean, for example, mechanically attached (e.g., bolted, welded, bonded, etc.), integrally formed with (e.g., cast), machined such as from a common block of material (e.g., CNC machined), additively and/or subtractively formed (e.g., 3D printed or fabricated), etc.

Certain embodiments relate to seating systems utilizing specially-configured floor tracks, seats, and other components to provide tiered seating and corresponding tiered footrests particularly on substantially flat (i.e., non-sloped) floors. Floor tracks are generally configured to sit directly on a floor or other surface (and can be mechanically attached to the floor or surface if necessary or desirable) and can be configured to support one, two, or more rows of seats. Where multiple rows are supported, the rows can be placed at predetermined distances apart from one another. Importantly, the height of each row above the floor track is independently adjustable so that tiered seating arrangements can be created, even on a flat floor. Thus, the system is adjustable as to such things as number of rows, depth of rows, distance between rows, and row elevations.

Floor tracks have been used before in seating systems, including a floor track and seating system patented in U.S. Pat. No. 8,733,838 and a floor rail system described in U.S. Pat. No. 1,931,289, each of which is hereby incorporated herein by reference.

One potential issue with tiered seating is that, as the height of a row is increased, it may become difficult or impossible for a user to rest their feet on the floor or may generally be uncomfortable, which may lead to the seating being uncomfortable for some users. Therefore, in certain embodiments, the floor tracks also can provide supports for one or more footrests for each row. The footrest(s) may be made of any appropriate material or combination of materials (e.g., metal, plastic, fabric, rubber, etc.). The footrest(s) may be adjustable-height such that, when a particular row is raised or lowered, the corresponding footrest(s) for that row also can be raised or lowered. The footrest(s) additionally or alternative could be adjustable in depth and/or angle such as to improve comfort.

Also, an important safety consideration in a track-based seating system is that the seating system generally must meet certain requirements (e.g., bylaws or other regulations) for space between rows, e.g., to ensure that users can ingress and egress without undue hardship and also to ensure that there are no tripping hazards. In certain embodiments, the footrest(s) are configured to allow for safe ingress and egress.

FIG. 1 is a schematic top view diagram of a two-row seating system formed using four floor tracks 102, in accordance with certain exemplary embodiments. Generally speaking, each pair of adjacent floor tracks supports a set of one or more seats, which generally will be interconnected in one way or another. Thus, for example, each set of one or more seats can be provided as a partially- or fully-assembled seating module configured to fit between two floor tracks set a predetermined distance apart. In FIG. 1, there are three-seat modules (e.g., seats 1-2-3 and seats 4-5-6 in each row) and there are two-seat modules (e.g., seats 7-8 in each row), although the present invention is not limited to any particular number or configuration of seats. In FIG. 1, the floor tracks 102 are configured to support two rows of seats, although the present invention is not limited to any particular number of rows (e.g., one, two, three, four, or more rows).

Figure 2:
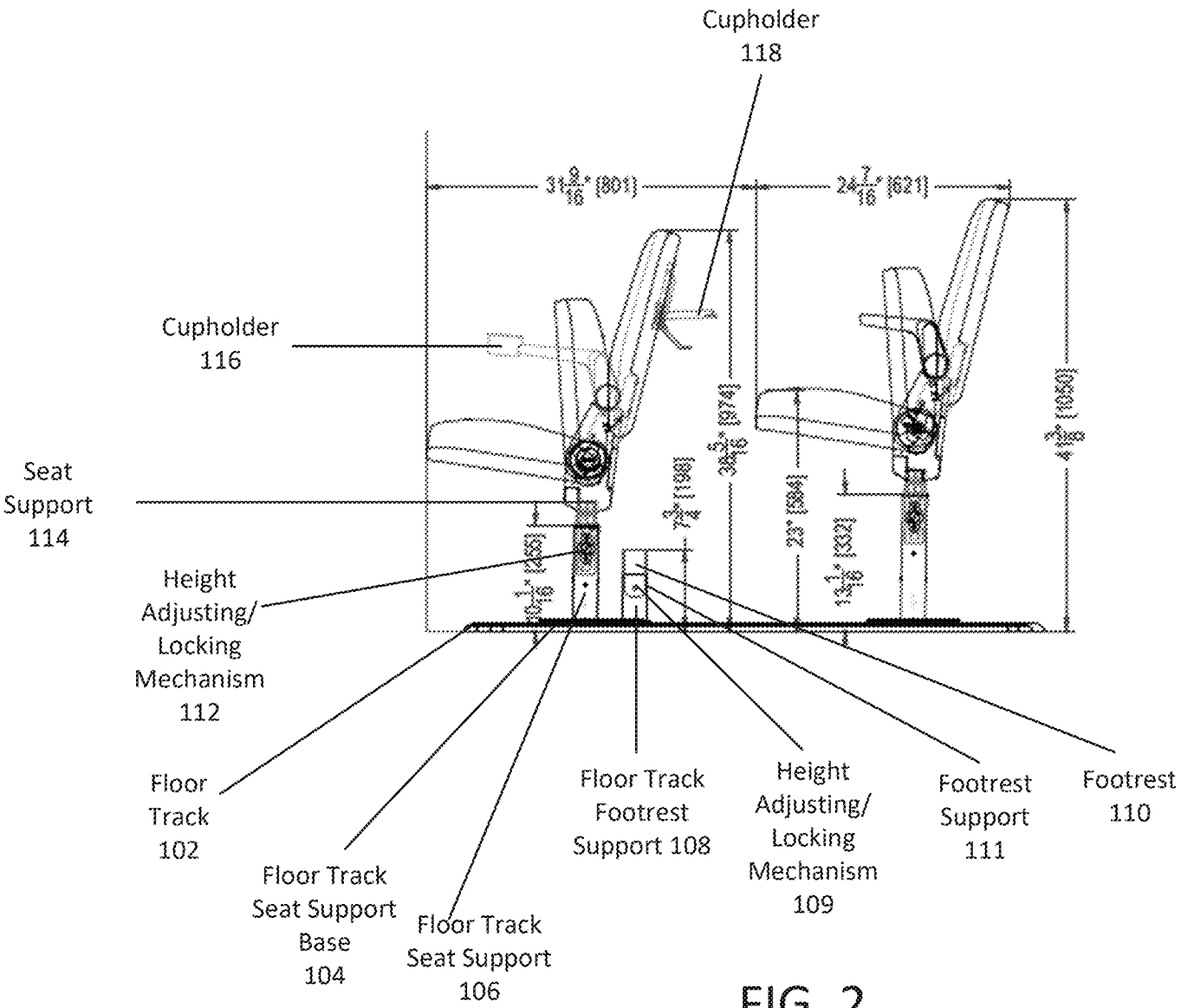
FIG. 2 is a schematic side view of the two-row seating system of FIG. 1.

FIG. 2 is a schematic side view of the two-row seating system of FIG. 1. As shown, this floor track 102 is configured to support two rows of seats.

For each row, the floor track 102 preferably includes a floor track seat support base 104 attached to the floor track 102 and a floor track seat support 106 attached to the floor track seat support base 104. A seat module having one or more seats includes a seat support 114 configured to be secured to the floor track seat support 106 by a height adjusting/locking mechanism 112 allowing the seating of the seat module to be selectively raised and lowered relative to the floor track 102 as needed. It should be noted that the seat support 114 can be any appropriate seat support having elements that fit into or onto or otherwise can attach to the floor track seat support 106, e.g., the seat support 114 may include a section of round or square tubing to which the seat(s) are directly or indirectly attached (e.g., bolted or welded onto the tubing) and that extends between two floor tracks and includes vertical end portions that fit into or onto or otherwise can attach to the floor track seat support 106, although other configurations are certainly possible, and the present invention is not limited to any particular type of seating, seat support, seat module, etc. It should be noted that the present invention is not limited to any particular height adjusting/locking mechanism 112. For example, the height adjusting/locking mechanism 112 could include a bolt or other fastener that passes through holes in the seat support 114 and floor track seat support 106 or even could include different size/height inserts that are placed in the floor track seat support 106 prior to insertion of the seat support 114 (e.g., a 1" insert, a 2" insert, a 3" insert, a 4" insert, a 5" insert, etc.).

In the example shown in FIG. 2, the front row is raised by 2" relative to a nominal height and the back row is raised by 5" relative to the nominal height (i.e., 3" higher than the front row). Because the back row is raised 5" above nominal, the users of the back row seating may be unable to rest their feet on the ground or otherwise might find it uncomfortable to sit in the seats. Therefore, the floor track 102 preferably also includes one or more floor track footrest supports 108 for supporting an adjustable-height footrest 110. The floor track footrest support(s) 108 may be attached directly to the floor track 102, to the floor track seat support base 104 (sometimes referred to herein as a combination seat/footrest support 1004 that attaches to the floor track 102, for example, as depicted schematically in FIG. 16 and shown in FIGS. 5-7), to a separate footrest support base that attaches to the floor track 102, to the floor track seat support 106, or elsewhere, although it should be noted that, in any case, the footrest(s) 110 are preferably positioned such that they do not impede ingress or egress of users within the row of seating (e.g., the footrests 110) may be tucked in below the front row of seats in order to allow sufficient floor space for ingress and egress without causing a tripping hazard. It should be noted that floor track footrest support(s) 108 may be omitted from certain rows, e.g., if no additional footrest is needed or when the seating arrangement does not readily accommodate footrests for the row (e.g., at a first row of a venue with no seating in front of it). The footrest 110 includes a footrest support 111 configured to be secured to the floor track footrest support 108 by a height adjusting/locking mechanism 109 allowing the footrest 110 to be selectively raised and lowered relative to the floor track 102 as needed. It should be noted that the footrest support 111 can be any appropriate footrest support having elements that fit into or onto or otherwise can attach to the floor track footrest support 108, e.g., the footrest support 111 may include a section of round or square tubing to which the footrest 110 is directly or indirectly attached (or in some cases the footrest support 111 may be the footrest 110 itself) and that extends between two floor tracks and includes vertical end portions that fit into or onto or otherwise can attach to the floor track footrest support 108, although other configurations are certainly possible, and the present invention is not limited to any particular type of footrest or footrest support. It should be noted that the present invention is not limited to any particular height adjusting/locking mechanism 109. For example, the height adjusting/locking mechanism 109 could include a bolt or other fastener that passes through holes in the floor track footrest support 108 and footrest support 111 or even could include different size/height inserts that are placed in the floor track footrest support 108 prior to insertion of the footrest support 111 (e.g., a 1" insert, a 2" insert, a 3" insert, a 4" insert, a 5" insert, etc.). The footrest(s) additionally or alternative could be adjustable in depth (e.g., having different connection points on the floor track, or being connected to the footrest support 108 using an adjustable mechanism) and/or angled such as to improve comfort. As depicted schematically in FIG. 1, footrests can be individual footrests (e.g., two footrests per seat), can be single seat width footrests 406, or can span multiple seats widths 408. As shown, some footrests supports and/or footrests may be positioned between floor tracks and thus the footrest supports 108 additionally or alternatively may be attached to other structures, e.g., to the seats or seat supports.

It should be noted that floor track seat supports 106 and footrest supports 108 could be provided in multiple heights to provide additional flexibility in configuring tiered seating. It also should be noted that the height adjusting/locking mechanism 112 and the height adjusting/locking mechanism 109 may use the same type of height adjusting/locking mechanism or may use different types of height adjusting/locking mechanisms. It also should be noted that various alternative embodiments may omit the floor track seat support 106 and instead attach components directly to the floor track 102.

It is contemplated that certain embodiments will include additional convenience features such as a side cupholder 116 (which may be placed on a separate arm that can rotate up and down) or a seatback cupholder 118 (which may store within the seatback and allow for opening and closing of the cupholder 118). One or both of the cupholders 116 and 118 may additionally or alternatively include a tray.

Figure 3:
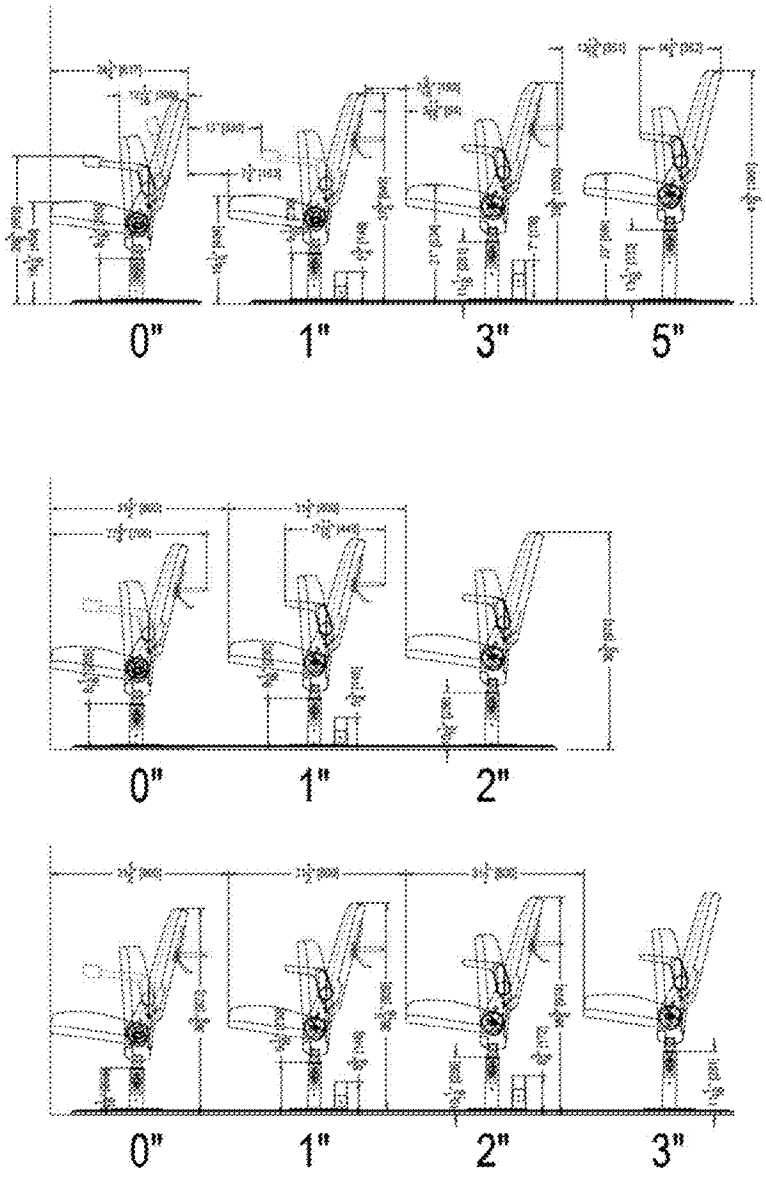
FIG. 3 is a schematic side view of some additional seating configurations consistent with this disclosure.

FIG. 3 is a schematic side view of some additional seating configurations consistent with this disclosure including a first configuration in which one floor track supports one row of seating and the other floor track supports three rows of seating (top view of FIG. 3), a second configuration in which the floor track supports three rows of seats (middle view of FIG. 3), and a third configuration in which the floor track supports four rows of seating (bottom view of FIG. 3). Of course, other configurations are possible.

It should be noted that, in some cases, a single floor track will support two adjacent seat modules in the same row (e.g., the floor track between seats 3-4 and the floor track between seats 6-7 shown in FIG. 1 each support two adjacent seat modules). Thus, for example and without limitation, the floor track seat support 106 may be configured to accommodate two seat supports 114, or the floor track 102 may include two floor track seat supports 106 adjacent to one another, or other arrangement may be included to support two adjacent seat modules (e.g., attaching the two adjacent seat modules to a common central seat support 114).

In order to further provide space between the two rows, the seats are preferably "flip-up" seats and the seat bottoms are preferably biased to flip up into a closed position when the seat is vacant. In this way, the seat bottoms of unused seats can automatically move out of the way of a user as they pass through an empty row.

It should be noted that the seats and seating system may include other features, e.g., cup holders (e.g., on fixed or movable seat arms or elsewhere), seatback trays, coat/purse hooks, adjustable seat backs, seat warmers, etc.

Figure 4:
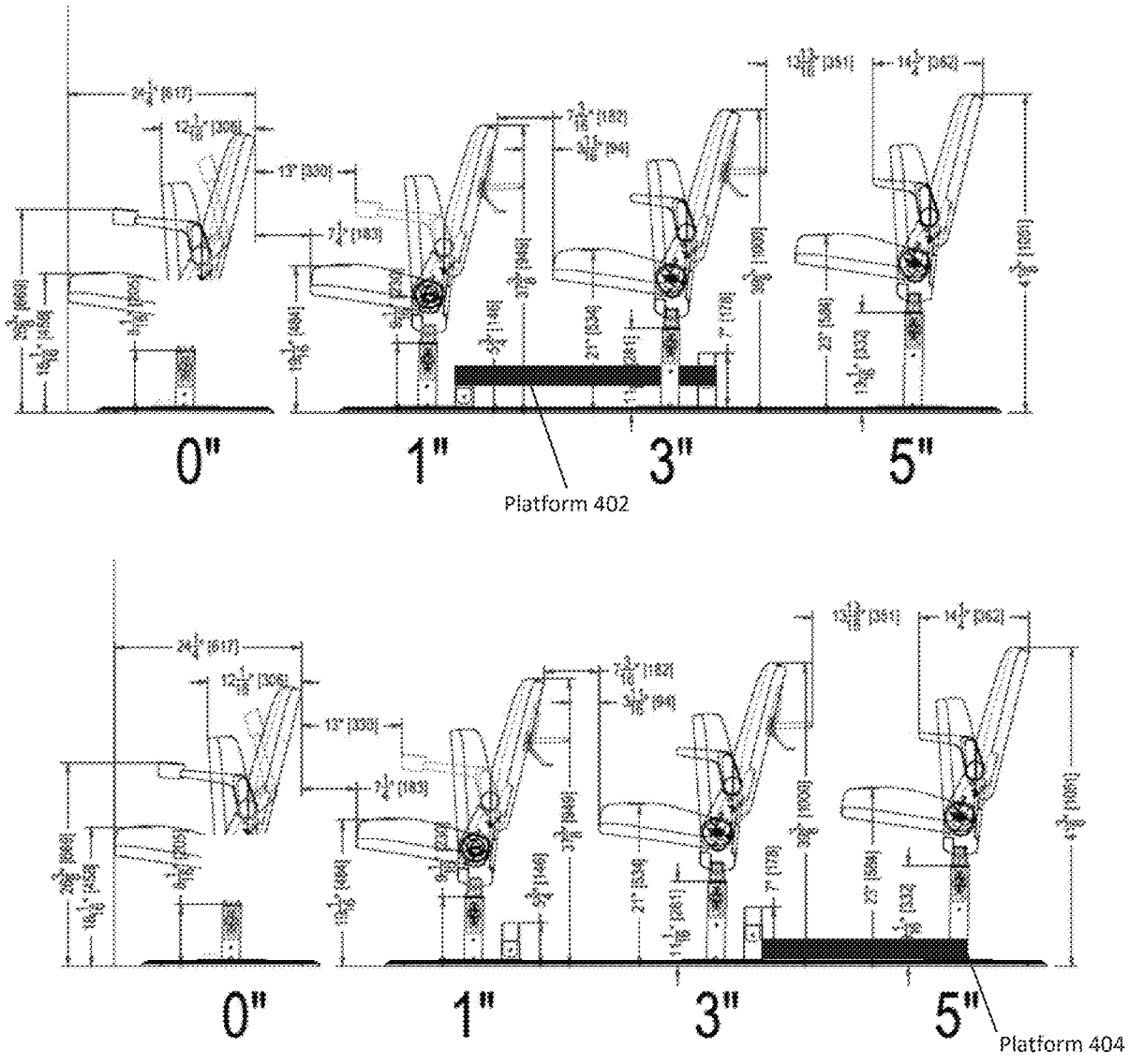
FIG. 4 is a schematic diagram showing an optional platform installed using existing footrest supports or other mechanisms, in accordance with various embodiments.

In various alternative embodiments, the floor track system may support a platform for use as a raised walking surface. Such a platform may be particularly useful for rows in which the seats are raised significantly, e.g., by 5" or more. The platform could be installed using the existing footrest supports, for example, as depicted schematically by platform 402 in FIG. 4. In this way, the platform could be height-adjustable along with the seat heights, and footrests could be provided in other ways such as on top of the platform. However, the platform could be supported in other ways, e.g., directly on the floor tracks, for example, as depicted schematically by platform 404 in FIG. 4.

Figure 5:
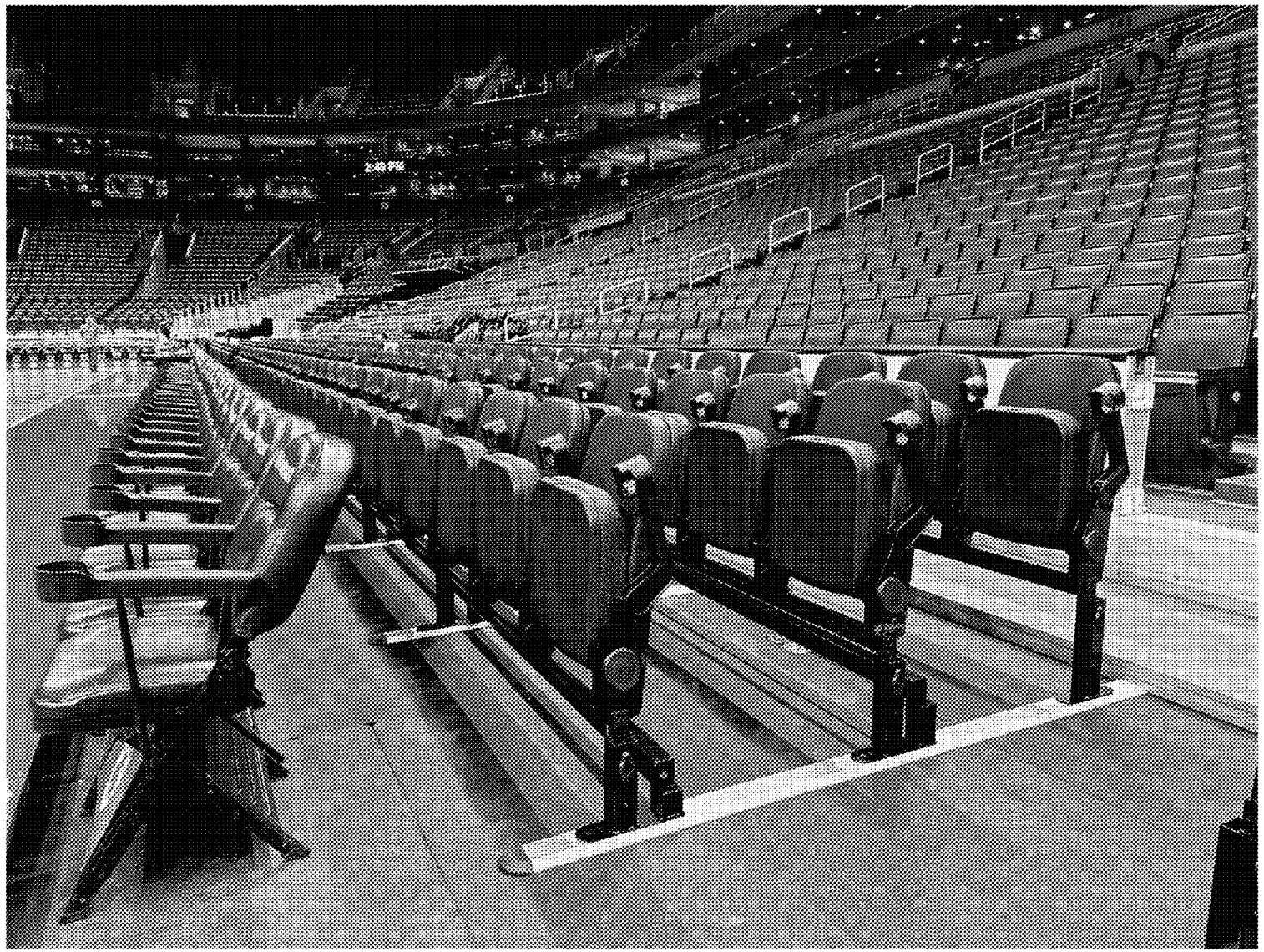
FIG. 5 is a photograph showing three rows of seating including footrest support and footrests for the second and third rows adjusted in height corresponding to the heights of the second and third row seats in accordance with certain embodiments.

FIG. 5 is a photograph showing three rows of seating including footrest support and footrests for the second and third rows adjusted in height corresponding to the heights of the second and third row seats in accordance with certain embodiments.

Figure 6:
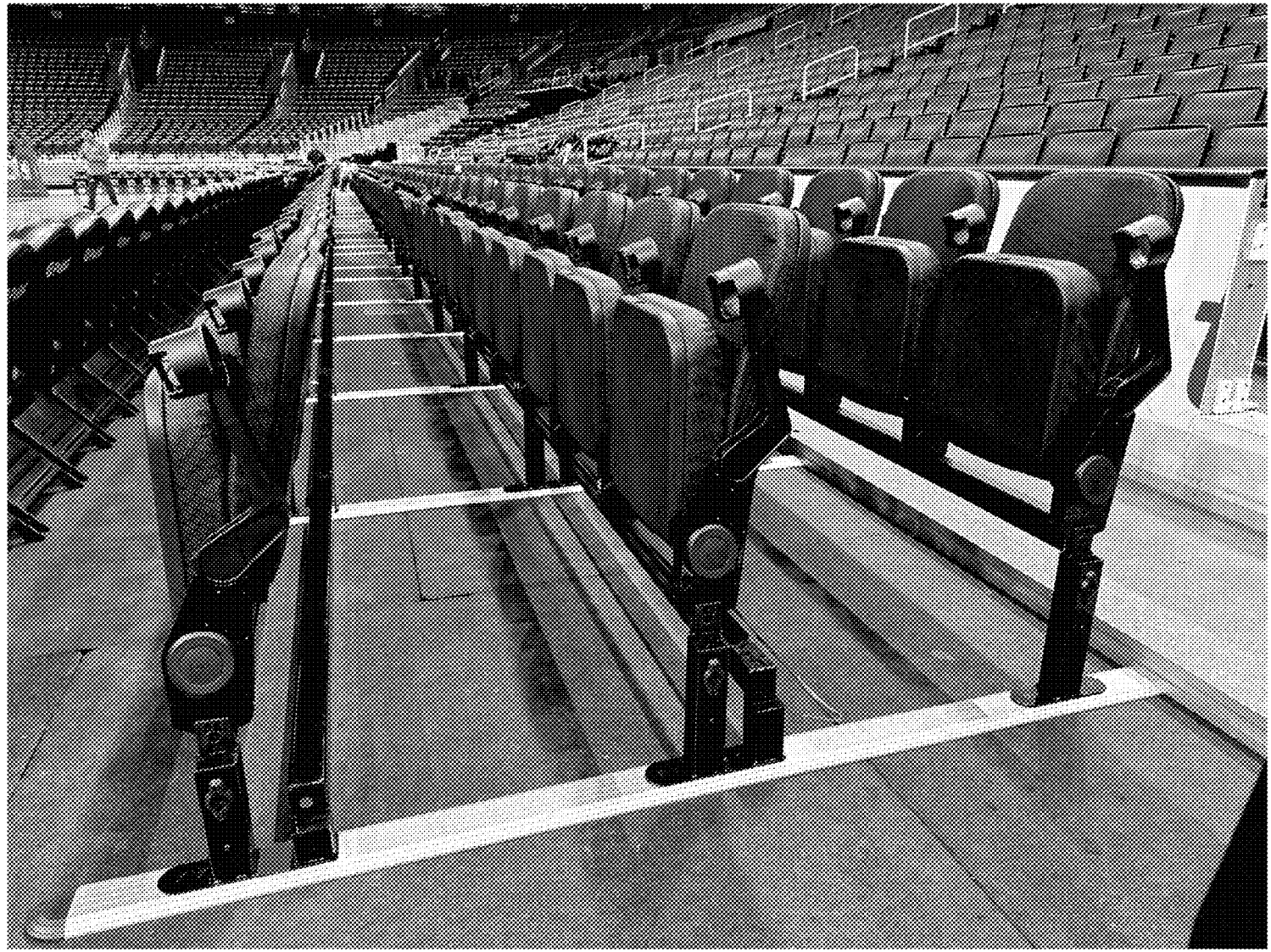
FIG. 6 is a photograph showing another view of the seating shown in FIG. 5.

FIG. 6 is a photograph showing another view of the seating shown in FIG. 5.

Figure 7:
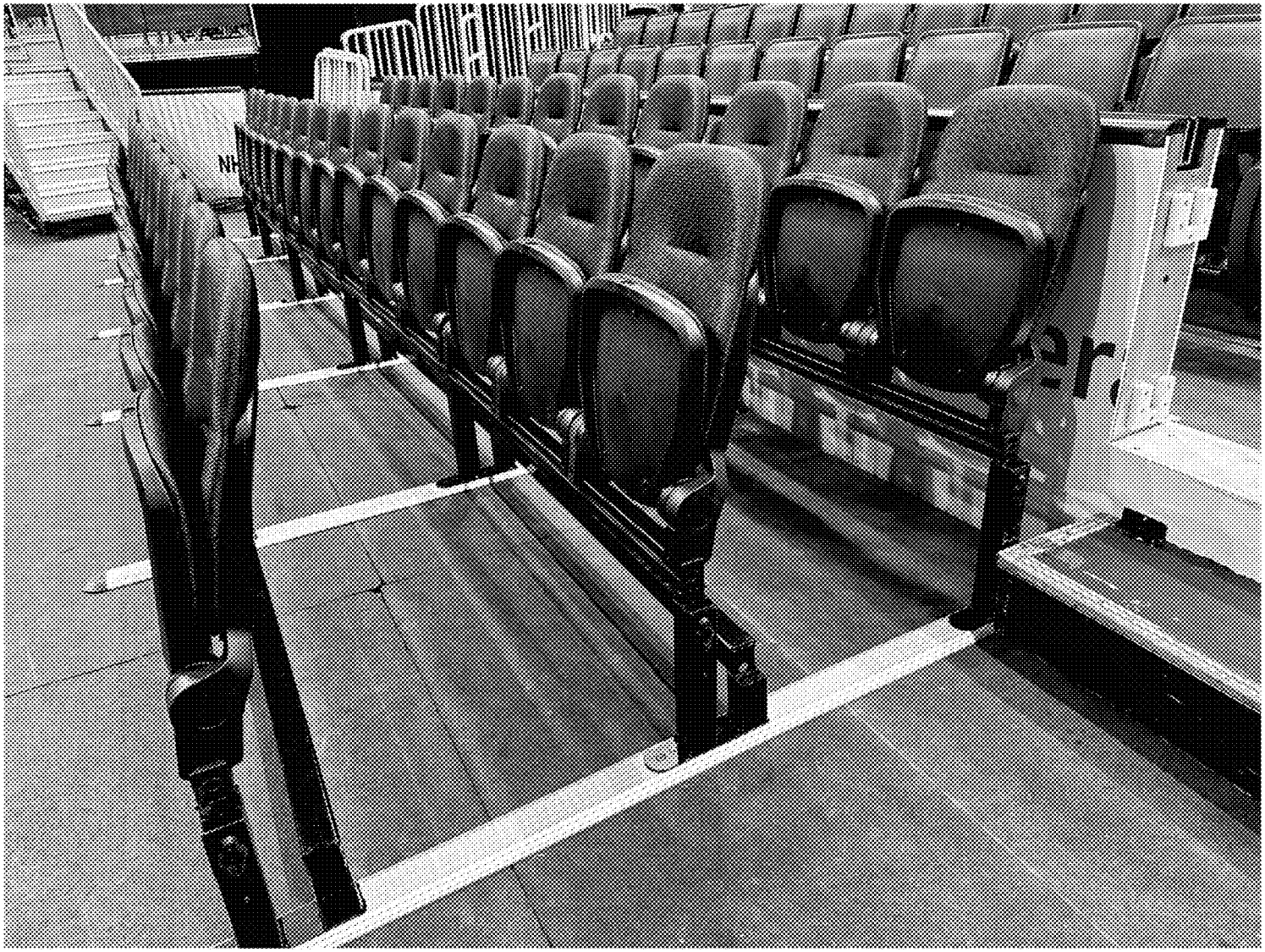
FIG. 7 is a photograph showing another three rows of seating including footrest support and footrests for the second and third rows adjusted in height corresponding to the heights of the second and third row seats in accordance with certain embodiments.

FIG. 7 is a photograph showing another three rows of seating including footrest support and footrests for the second and third rows adjusted in height corresponding to the heights of the second and third row seats in accordance with certain embodiments.

Figure 8:
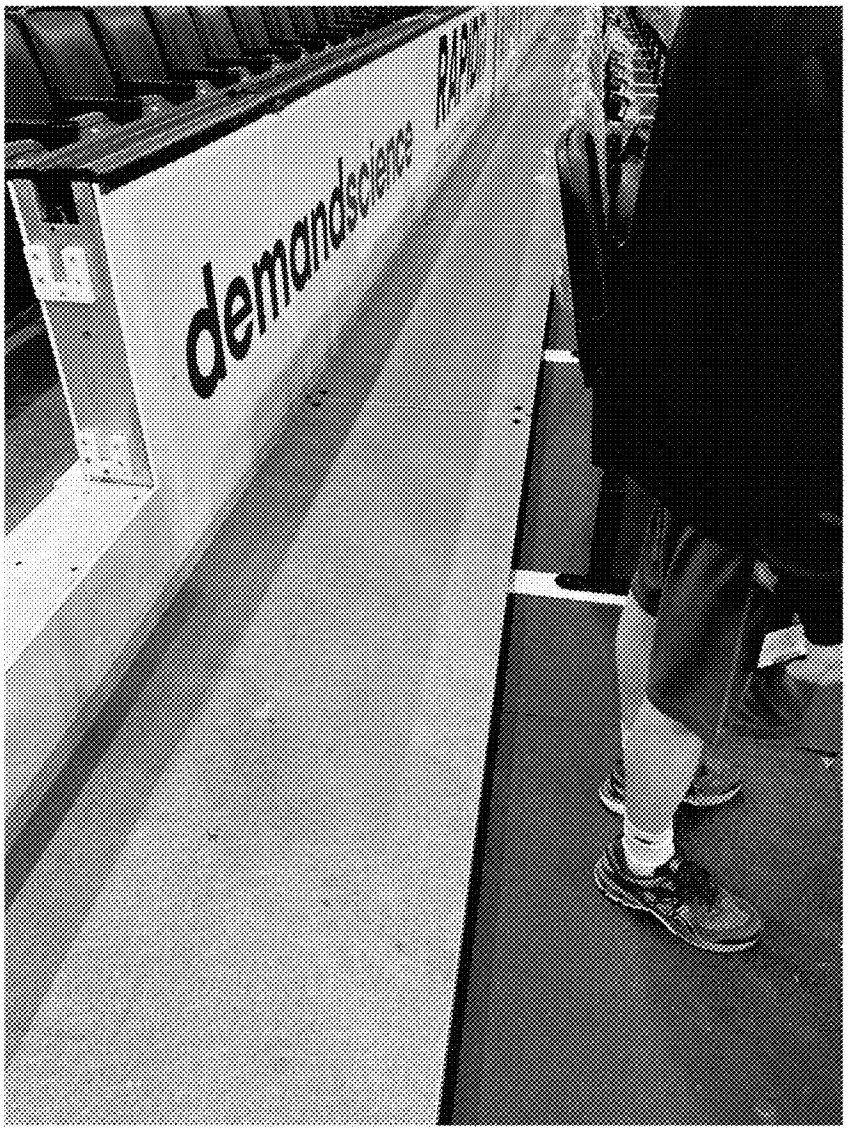
FIG. 8 shows the space behind the back row of seating created by the top of the backrest in substantial vertical alignment with the edge of the walkway in accordance with certain embodiments.

FIG. 8 shows the space behind the back row of seating created by the top of the backrest in substantial vertical alignment with the edge of the walkway in accordance with certain embodiments.

In addition to, or in lieu of, having footrests, embodiments could include a platform to provide a raised floor for a row of seating. The platform could rest on or between floor tracks.

Figure 9:
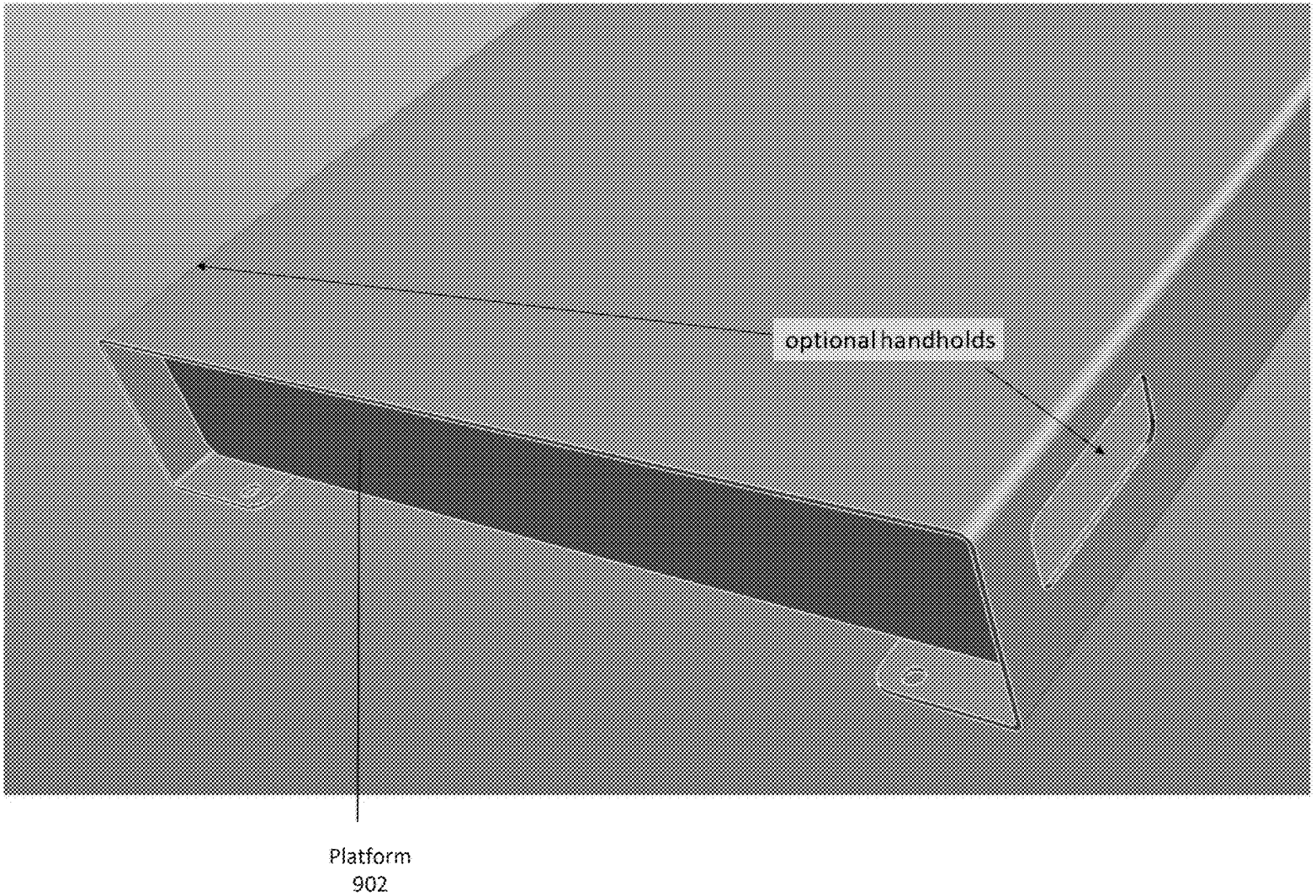
FIG. 9 is a schematic diagram of a platform including two optional handholds on each end of the platform to facilitate moving and positioning the platform in accordance with certain embodiments.

FIG. 9 is a schematic diagram of a platform 902 including two optional handholds on each end of the platform to facilitate moving and positioning the platform in accordance with certain embodiments.

Figure 10:
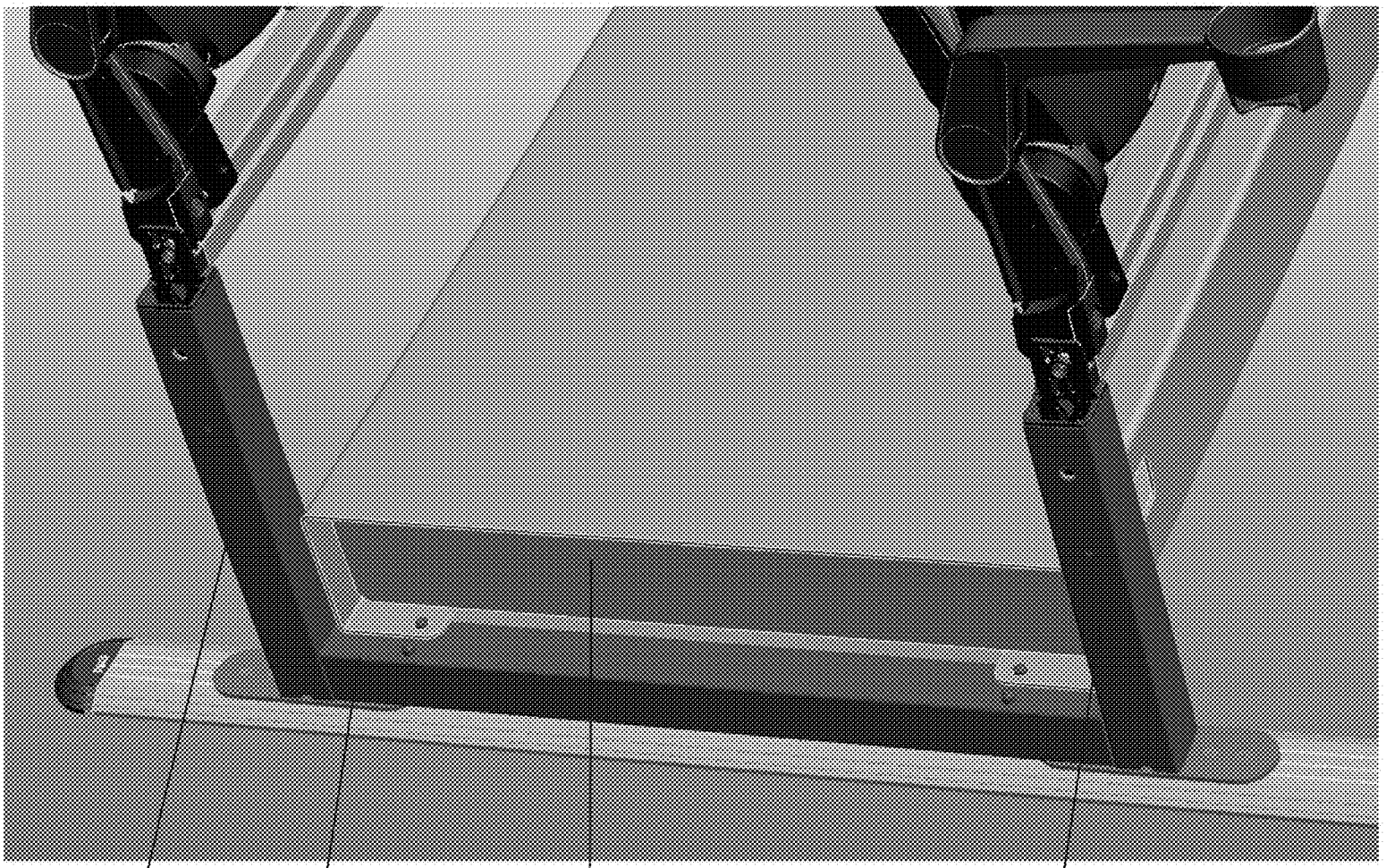
FIG. 10 is a schematic diagram showing a detailed view of the platform of FIG. 9 positioned within a row of seating in accordance with certain embodiments.

FIG. 10 is a schematic diagram showing a detailed view of the platform 902 of FIG. 9 positioned within a row of seating and resting on the floor track, in accordance with certain embodiments. This embodiment includes a combination seat/platform support 1002 that attaches to the floor track and supports the platform 902 and also provides floor track seat supports 106 for two rows of seating.

Figure 11:
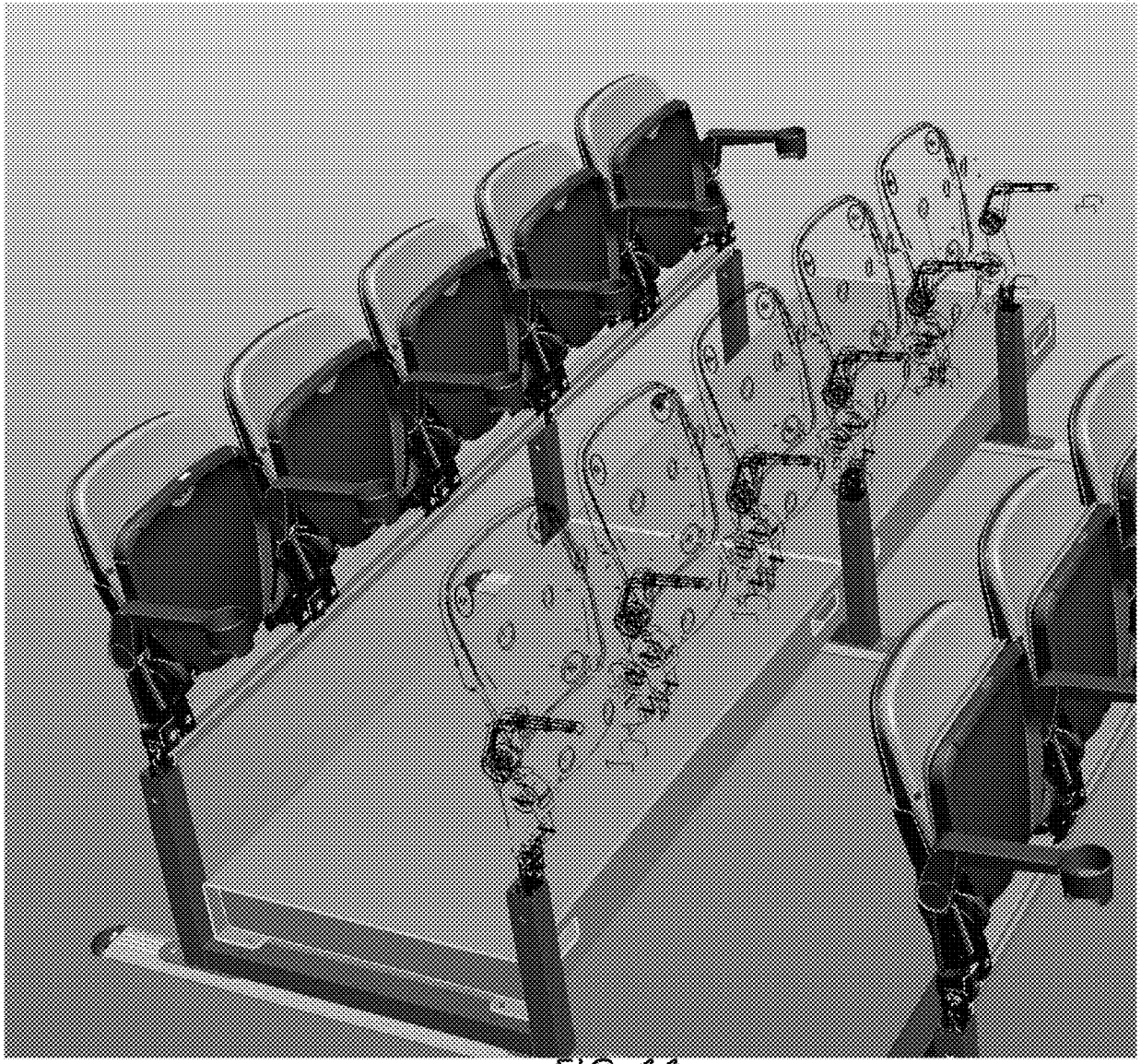
FIG. 11 is a schematic diagram showing an exploded view of the platform of FIG. 9 positioned within a row of seating in accordance with certain embodiments.

FIG. 11 is a schematic diagram showing an exploded view of the platform 902 of FIG. 9 positioned within a row of seating in accordance with certain embodiments.

Figure 12:
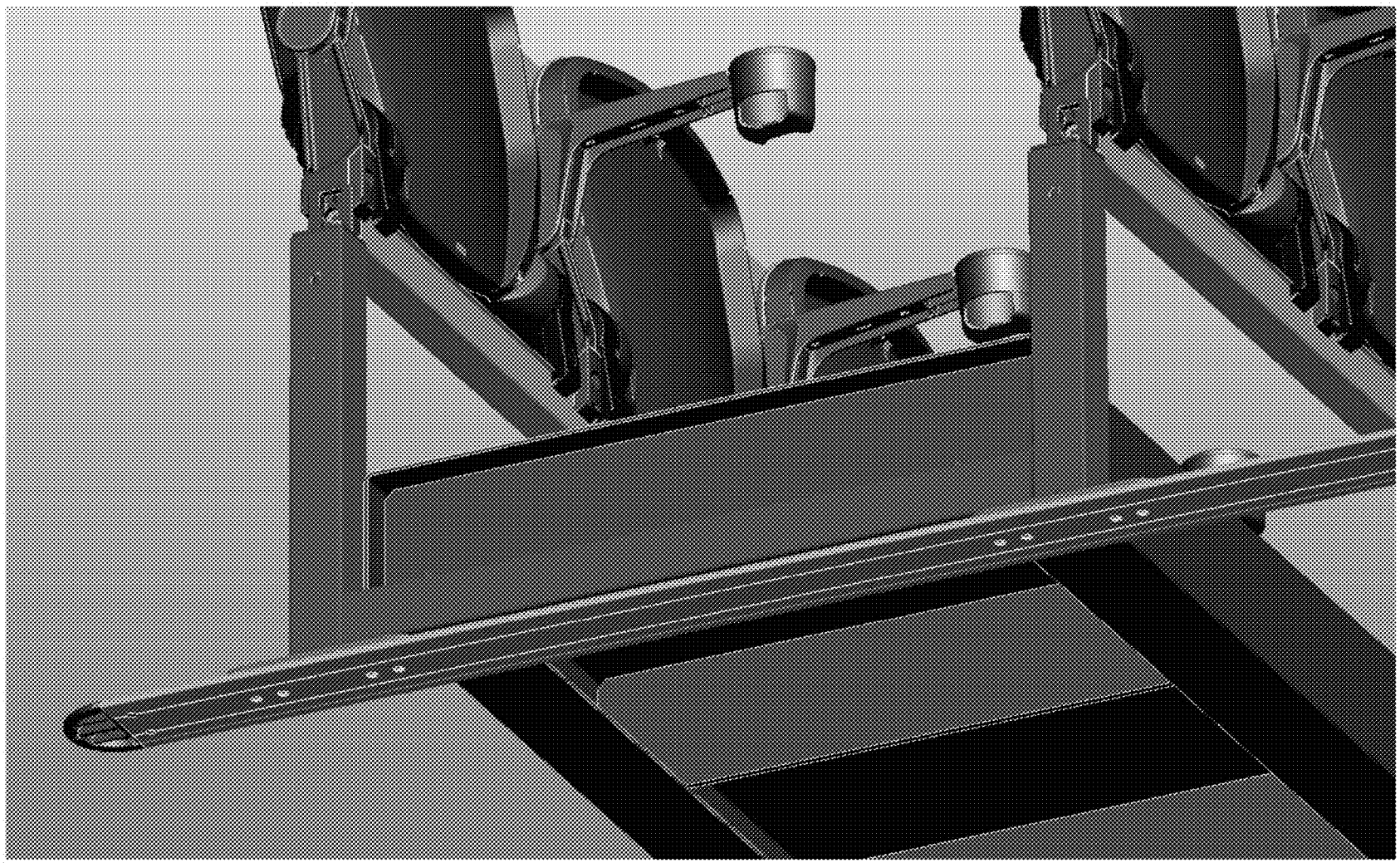
FIG. 12 is a schematic diagram showing an underneath perspective view of the floor track with seating and platform in accordance with certain embodiments.

FIG. 12 is a schematic diagram showing an underneath perspective view of the floor track with seating and platform 902 in accordance with certain embodiments.

Figure 13:
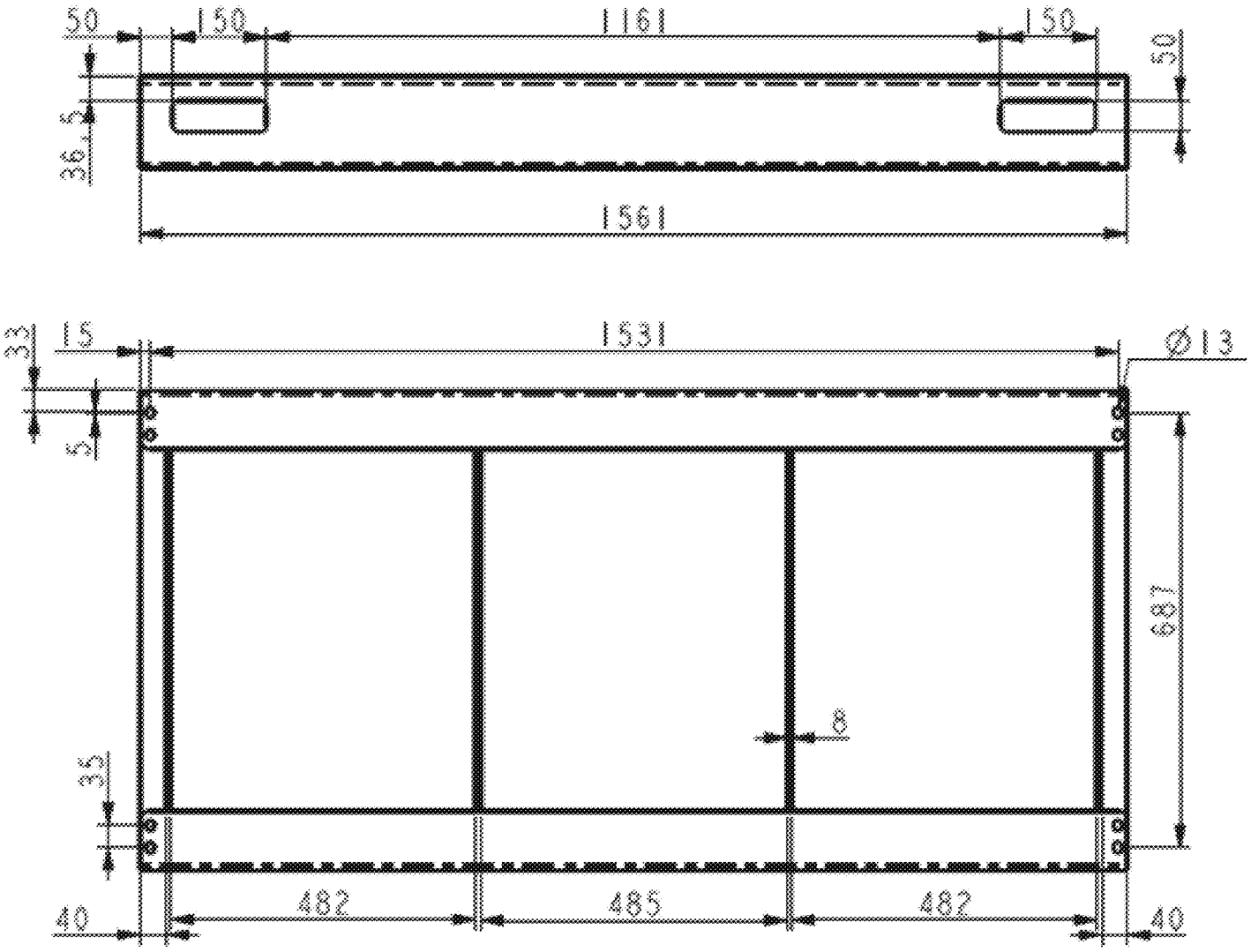
FIG. 13 is a schematic diagram showing bottom and side views of a platform in accordance with certain embodiments.

FIG. 13 is a schematic diagram showing bottom and side views of a platform 902 in accordance with certain embodiments in accordance with certain embodiments.

Figure 14:
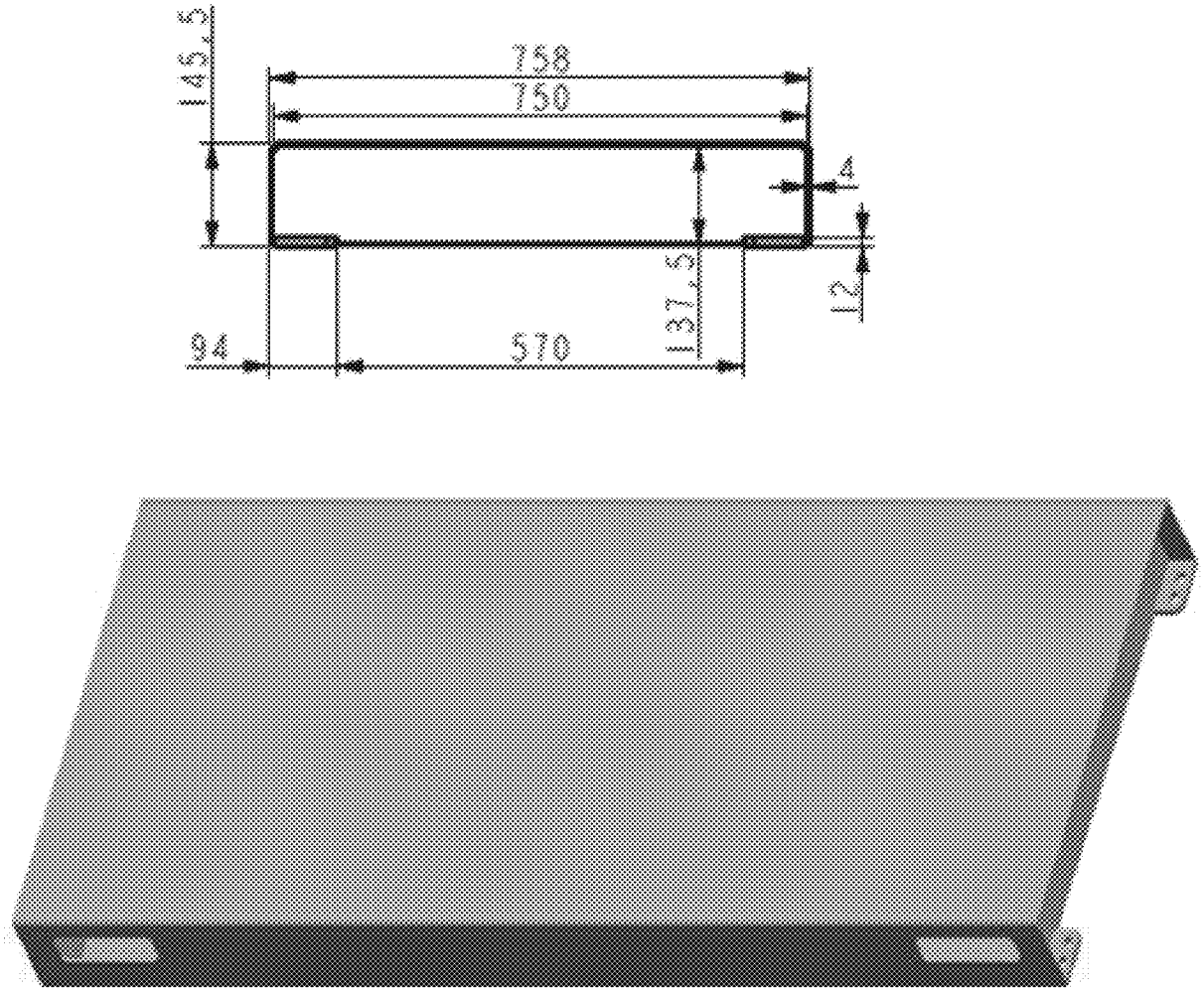
FIG. 14 is a schematic diagram showing and end view of a platform and a top perspective view of a platform in accordance with the embodiment of FIG. 13.

FIG. 14 is a schematic diagram showing an end view and a top perspective view of a platform 902 in accordance with the embodiment of FIG. 13.

It should be noted that FIGS. 10-12 show optional cup holders that can be folded down during usage and folded up when not in use or during egress.

FIGS. 15-26 are schematic diagrams showing additional schematic details of various components of the system in accordance with certain embodiments.

Figure 15:
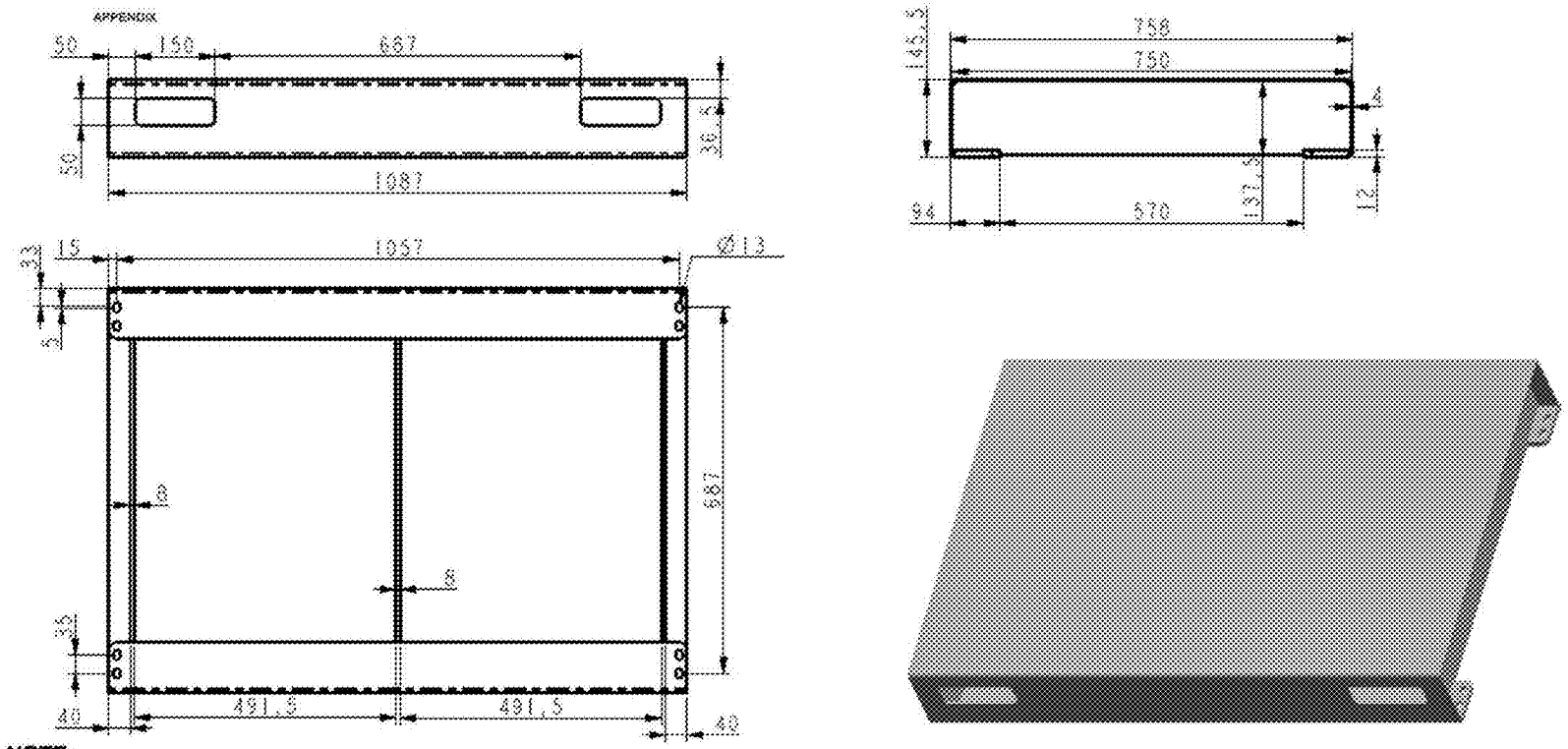
FIG. 15 is a schematic diagram showing bottom, side, end, and perspective views of an alternative platform in accordance with certain embodiments.

FIG. 15 is a schematic diagram showing bottom, side, end, and perspective views of an alternative platform 902 in accordance with certain embodiments.

FIG. 16 is a schematic diagram showing components including a combination seat/platform support 1002 and a combination seat/footrest support 1004 in accordance with certain embodiments. Note here that the two floor track seat supports 106 of the combination seat/platform support 1002 may be fabricated to different heights (e.g., 422 mm and 499 mm in this example). Also note here that combination seat/footrest supports 1004 may be fabricated in multiple heights (270/84.5 mm and 346/135.5 mm in this example).

Figure 17:
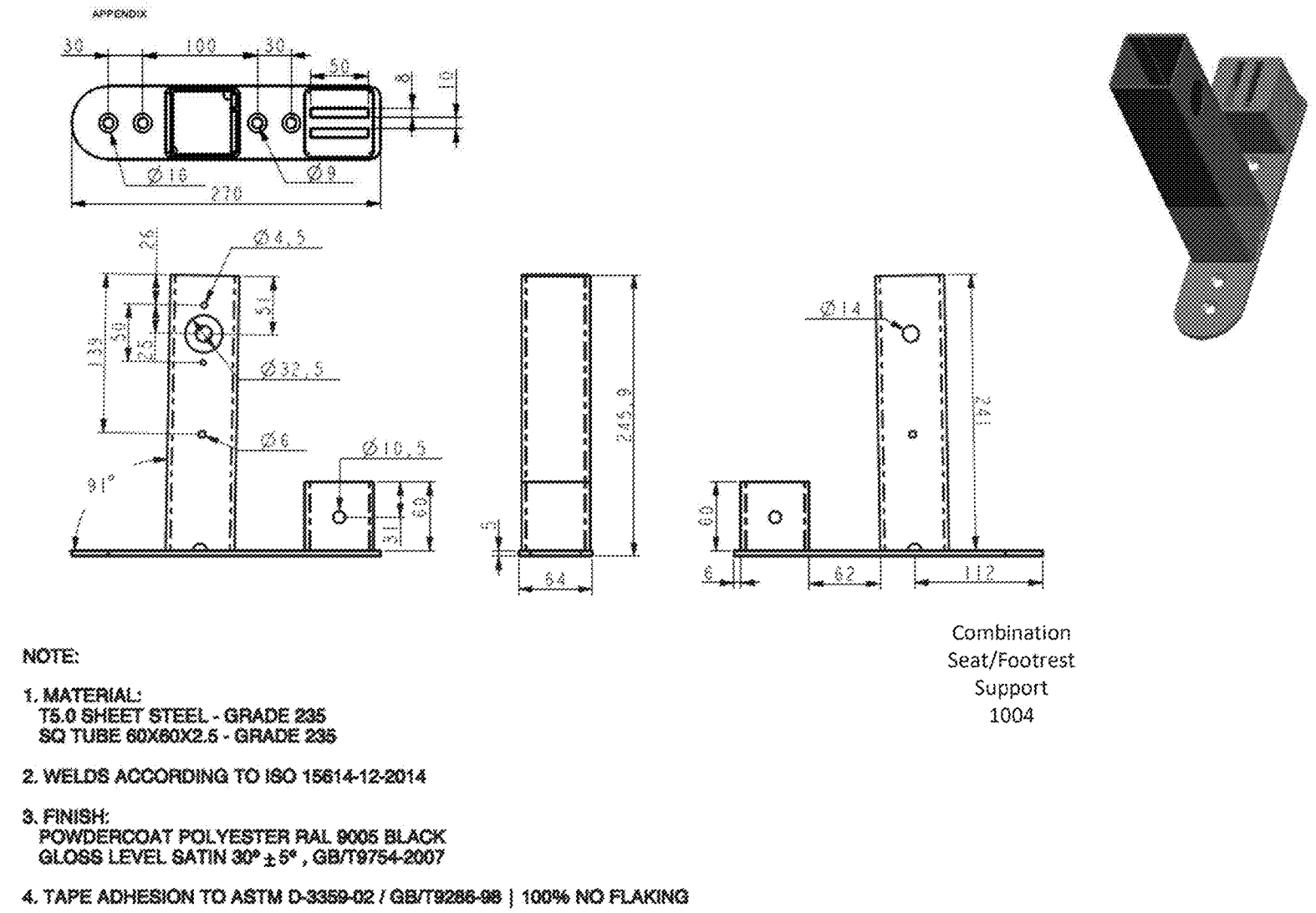
FIGS. 17-18 are schematic diagrams showing top and side views of two combination seat/footrest supports in accordance with certain embodiments.
Figure 18:
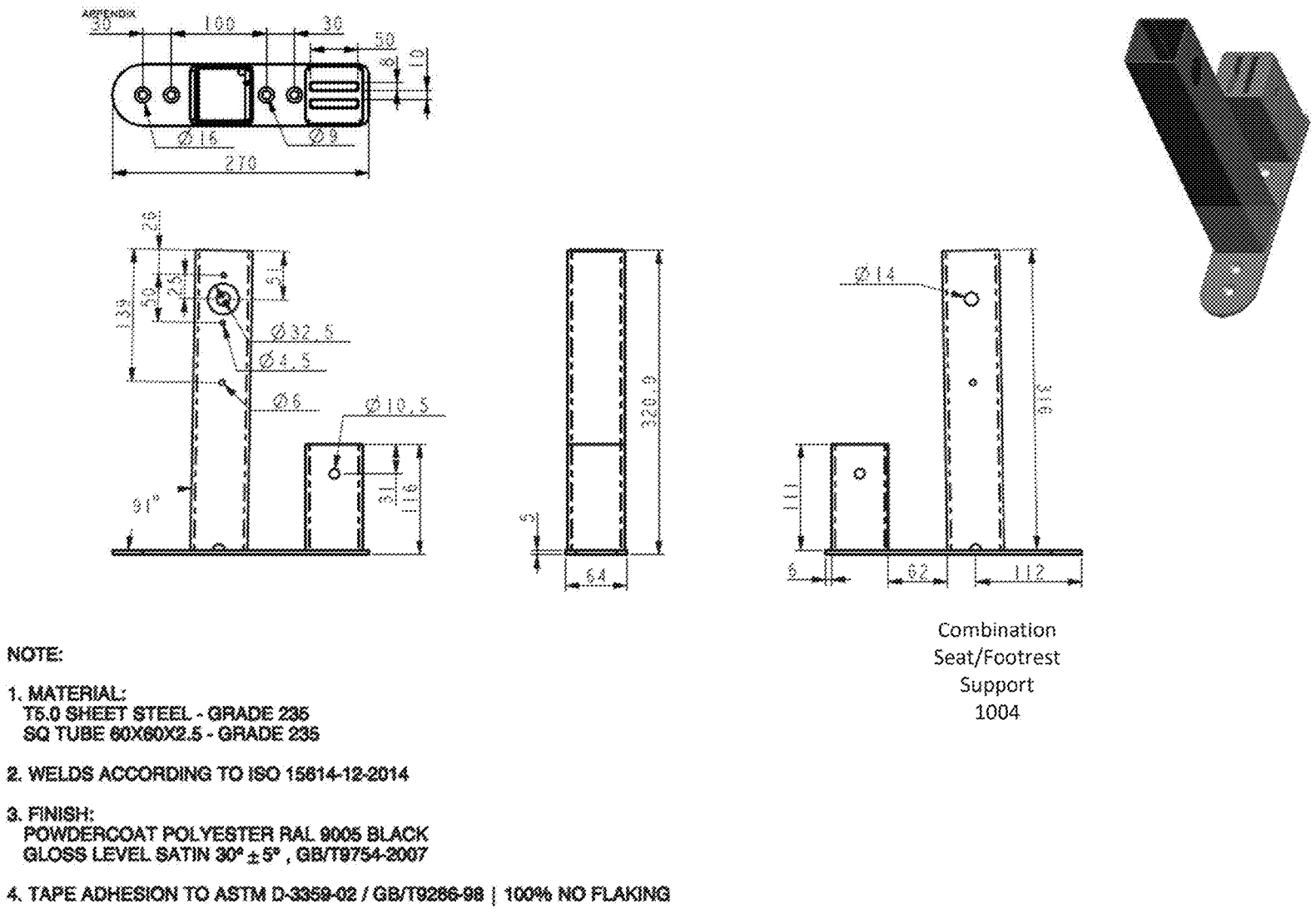

FIGS. 17-18 are schematic diagrams showing top and side views of two combination seat/footrest supports 1004 in accordance with certain embodiments.

FIGS. 19-20 are schematic diagrams showing two combination seat/footrest supports 1004 and related lock components in accordance with certain embodiments. In this example, the related lock components include a moulding that fits within the floor track seat support 106 for receiving the seat support 114 of a seating module, a limpet lock housing, a limpet lock pin, and screws to secure the limpet lock housing to the floor track seat support 106.

FIG. 21 is a schematic diagram showing front, top, and side views of a combination seat/platform support 1002 in accordance with certain embodiments.

FIG. 22 is a schematic diagram showing a combination seat/platform support 1002 with related lock components as in FIGS. 19-20 in accordance with certain embodiments.

Figure 23:
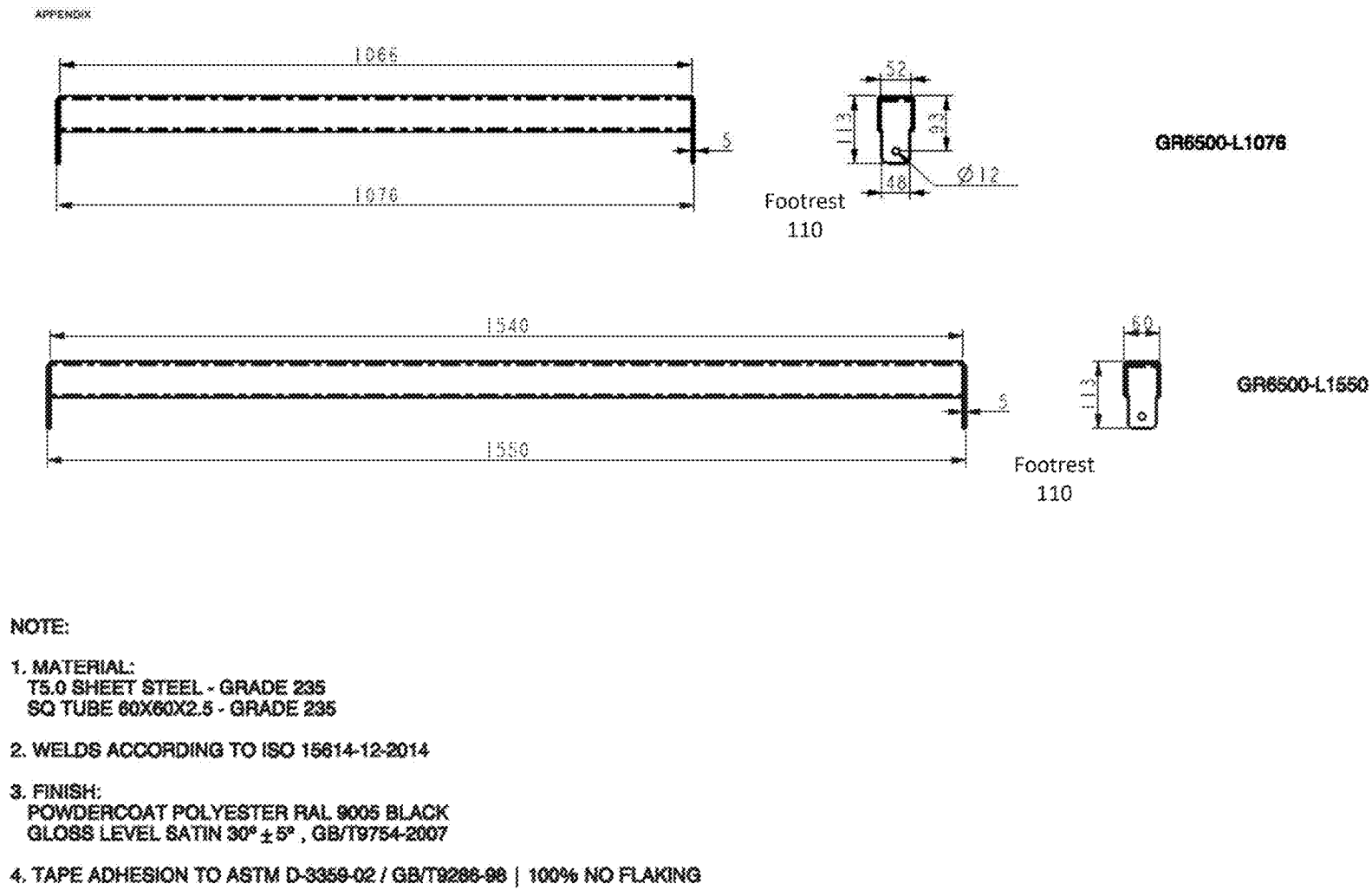
FIG. 23 is a schematic diagram showing two footrests in accordance with certain embodiments.

FIG. 23 is a schematic diagram showing two footrests 110 in accordance with certain embodiments.

Figure 25:
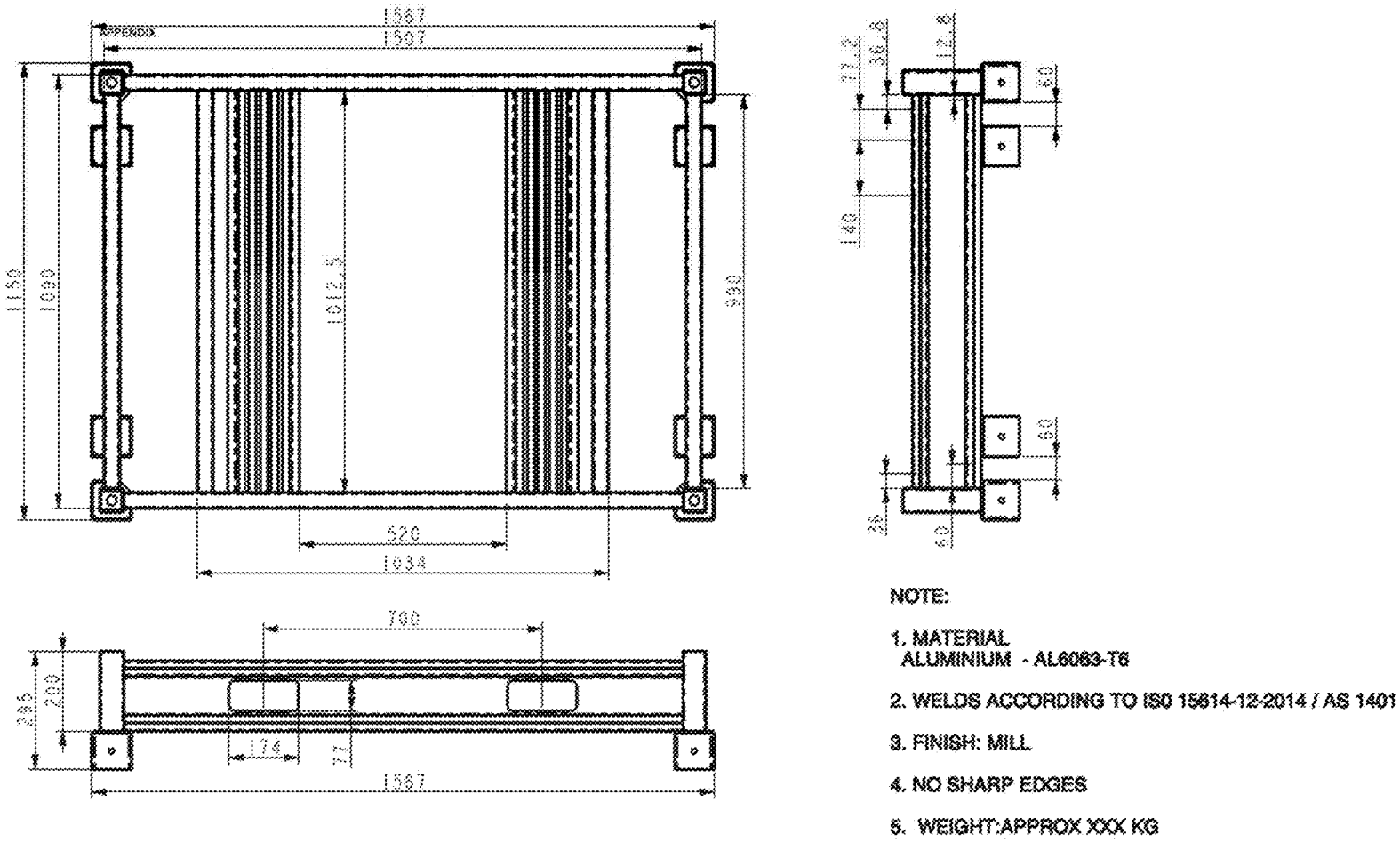

FIGS. 24-25 are schematic diagrams for a custom wheeled stillage for storing and moving system components in accordance with certain embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

Various inventive concepts may be embodied as one or more methods, of which examples have been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

As used herein in the specification and in the claims, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

Although the above discussion discloses various exemplary embodiments of the invention, it should be apparent that those skilled in the art can make various modifications that will achieve some of the advantages of the invention without departing from the true scope of the invention. Any references to the "invention" are intended to refer to exemplary embodiments of the invention and should not be construed to refer to all embodiments of the invention unless the context otherwise requires. The described embodiments are to be considered in all respects only as illustrative and not restrictive.

What is claimed is:

1. A floor track apparatus for a seating system, the floor track comprising:

a floor track;

a first floor track seat support attached to the floor track and configured to attach to a seat support of a first seating module for a first row of seating; and a first floor track footrest support attached to the floor track and configured to attach to a footrest support of a first footrest for a second row of seating behind the first row of seating, wherein the first seating module is height-adjustable via the first floor track seat support and the seat support of the first seating module, and wherein the first footrest is height-adjustable via the first floor track footrest support and the footrest support of the first footrest.

2. The floor track apparatus of claim 1, further comprising:

a height adjusting/locking mechanism for the first floor track seat support and the seat support of the first seating module.

3. The floor track apparatus of claim 1, further comprising:

a height adjusting/locking mechanism for the first floor track footrest support and the footrest support of the first footrest.

4. The floor track apparatus of claim 1, wherein the first floor track seat support and the first floor track footrest support are part of a combination seat/footrest support including a first floor track seat support base that attaches to the floor track and to which the first floor track seat support and the first floor track footrest support are attached.

5. The floor track apparatus of claim 1, further comprising:

a second floor track seat support attached to the floor track and configured to attach to a second seat support of a second seating module for the second row of seating; and a second floor track footrest support attached to the floor track and configured to attach to a second footrest support of a second footrest for a third row of seating behind the second row of seating, wherein the second row of seating is height-adjustable via the second floor track seat support and the second seat support, and wherein the second footrest is height-adjustable via the second floor track footrest support and the second footrest support.

6. The floor track apparatus of claim 1, wherein the first floor track seat support is configured to support two adjacent seating sections of the first row.

7. The floor track apparatus of claim 1, wherein the first footrest support is positioned to allow unimpeded passage through the second row of seating.

8. A seating system comprising:

a left side floor track comprising:

a first left side floor track seat support attached to the left side floor track and configured to attach to a left side seat support of a first seating module for a first row of seating; and a first left side floor track footrest support attached to the left side floor track and configured to attach to a left side footrest support of a first footrest for a second row of seating behind the first row of seating, wherein the first seating module is height-adjustable via the first left side floor track seat support and the left side seat support of the first seating module, and wherein the first footrest is height-adjustable via the first left side floor track footrest support and the left side footrest support of the first footrest; and a right side floor track comprising:

a first right side floor track seat support attached to the right side floor track and configured to attach to a right side seat support of the first seating module for the first row of seating; and a first right side floor track footrest support attached to the right side floor track and configured to attach to a right side footrest support of the first footrest for the second row of seating behind the first row of seating, wherein the first seating module is height-adjustable via the first right side floor track seat support and the right side seat support of the first seating module, and wherein the first footrest is height-adjustable via the first right side floor track footrest support and the right side footrest support of the first footrest.

9. The system of claim 8, further comprising:

a height adjusting/locking mechanism for the first left side floor track seat support and the left side seat support of the first seating module; and a height adjusting/locking mechanism for the first right side floor track seat support and the right side seat support of the first seating module.

10. The system of claim 8, further comprising:

a height adjusting/locking mechanism for the first left side floor track footrest support and the left side footrest support of the first footrest; and a height adjusting/locking mechanism for the first right side floor track footrest support and the right side footrest support of the first footrest.

11. The system of claim 8, further comprising a first left side floor track seat support base attached to the left side floor track and to which the first left side floor track seat support and the first left side floor track footrest support are attached; and a first right side floor track seat support base attached to the right side floor track and to which the first right side floor track seat support and the first right side floor track footrest support are attached.

12. The system of claim 8, wherein:

the left side floor track further comprises:

a second left side floor track seat support attached to the left side floor track and configured to attach to a left side seat support of a second seating module for the second row of seating; and a second left side floor track footrest support attached to the left side floor track and configured to attach to a left side footrest support of a second footrest for a third row of seating behind the second row of seating, wherein the second seating module is height-adjustable via the second left side floor track seat support and the left side seat support of the second seating module, and wherein the second footrest is height-adjustable via the second left side floor track footrest support and the left side footrest support of the second footrest; and the right side floor track further comprises:

a second right side floor track seat support attached to the right side floor track and configured to receive a right side seat support of the second seating module for the second row of seating; and a second right side floor track footrest support attached to the right side floor track and configured to receive a right side footrest support of the second footrest for the third row of seating behind the second row of seating, wherein the second seating module is height-adjustable via the second right side floor track seat support and the right side seat support of the second seating module, and wherein the second footrest is height-adjustable via the second right side floor track footrest support and the right side footrest support of the second footrest.

13. The system of claim 8, wherein at least one of the first left side floor track seat support or the first right side floor track seat support is configured to attach to two adjacent seating modules of the first row.

14. The system of claim 8, further comprising the first seating module, wherein the first seating module comprises the left side seat support attached to the first left side floor track seat support and the right side seat support attached to the first right side floor track seat support, and wherein the first seating module includes at least one seat.

15. The system of claim 14, wherein the first seating module includes a plurality of seats.

16. The system of claim 14, wherein each seat is a flip-up seat.

17. The system of claim 14, wherein the first seating module comprises a section of round or square tubing to which the at least one seat is attached and that extends between the left side floor track and the right side floor track and includes a vertical left side seat support end portion configured to attach to the first left side floor track seat support and a vertical right side seat support end portion configured to attach to the first right side floor track seat support.

18. The system of claim 14, wherein:

the left side seat support attaches to the first left side floor track seat support via a height adjusting/locking mechanism formed by the first left side floor track seat support including a first hole and the left side seat support including a plurality of second holes positioned at different vertical heights such that a bolt or other fastener can pass through the first hole and a selected second hole to position the left side of the first seating module at a selected height from a plurality of available heights; and the right side seat support attaches to the first right side floor track seat support via a height adjusting/locking mechanism formed by the first right side floor track seat support including a first hole and the right side seat support including a plurality of second holes positioned at different vertical heights such that a bolt or other fastener can pass through the first hole and a selected second hole to position the right side of the first seating module at a selected height from a plurality of available heights.

19. The system of claim 8, wherein the first left side footrest support and the first right side footrest support are positioned to allow unimpeded passage through the second row of seating.

20. The floor track apparatus of claim 2, wherein the height adjusting/locking mechanism for the first floor track seat support and the seat support of the first seating module is formed by the first floor track seat support including a first hole and the seat support including a plurality of second holes positioned at different vertical heights such that a bolt or other fastener can pass through the first hole and a selected second hole to position the first seating module at a selected height from a plurality of available heights.

21. A combination seat/footrest support for a floor track seating system, the combination seat/footrest support comprising:

a floor track seat support base configured to attach to a floor track;

a floor track seat support attached to the floor track seat support base and configured to attach to a seat support of a seating module for a first row of seating via a height adjustment/locking mechanism that allows height adjustment of the seating module; and a floor track footrest support attached to the floor track seat support base and configured to attach to a footrest support of a footrest for a second row of seating behind the first row of seating via a height adjustment/locking mechanism that allows height adjustment of the footrest.

* * * * *